US010499160B2

(12) United States Patent
Lim et al.

(10) Patent No.: US 10,499,160 B2
(45) Date of Patent: Dec. 3, 2019

(54) PLANAR MAGNET SPEAKER

(71) Applicant: SAMSUNG ELECTRONICS CO., LTD., Suwon-si (KR)

(72) Inventors: Dong-hyun Lim, Seoul (KR); Dong-kyu Park, Hwaseong-si (KR); Hae-kwang Park, Suwon-si (KR); Joon-ho Son, Suwon-si (KR); Dong-hyun Jung, Seoul (KR); Han-ki Kim, Suwon-si (KR); Young-suk Song, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/723,758

(22) Filed: Oct. 3, 2017

(65) Prior Publication Data

US 2018/0132041 A1 May 10, 2018

(30) Foreign Application Priority Data

Nov. 4, 2016 (KR) ..... 10-2016-0146907

(51) Int. Cl.

| | |
|---|---|
| ***H04R 9/06*** | (2006.01) |
| ***H04R 7/04*** | (2006.01) |
| ***H04R 7/18*** | (2006.01) |
| ***H04R 9/02*** | (2006.01) |
| ***H04R 9/04*** | (2006.01) |

(52) U.S. Cl.

CPC ..... *H04R 9/06* (2013.01); *H04R 7/04* (2013.01); *H04R 7/18* (2013.01); *H04R 9/025* (2013.01); *H04R 9/047* (2013.01)

(58) Field of Classification Search

CPC ..... H04R 9/046; H04R 9/047; H04R 9/06; H04R 7/04; H04R 2209/024; H04R 2209/041

See application file for complete search history.

(56) References Cited

U.S. PATENT DOCUMENTS

| | | | | |
|---|---|---|---|---|
| 3,960,043 A | | 6/1976 | Brand | |
| 3,997,739 A | * | 12/1976 | Kishikawa | H04R 9/047 381/408 |
| 4,210,786 A | * | 7/1980 | Winey | H04R 9/047 381/408 |

(Continued)

FOREIGN PATENT DOCUMENTS

| | | |
|---|---|---|
| EP | 1 073 312 A2 | 1/2001 |
| EP | 1 194 001 A1 | 4/2002 |

(Continued)

OTHER PUBLICATIONS

Communication dated Jan. 17, 2018 by the International Searching Authority in counterpart International Patent Application No. PCT/KR2017/011330. (PCT/ISA/210).

(Continued)

*Primary Examiner* — Joshua Kaufman

(74) *Attorney, Agent, or Firm* — Sughrue Mion, PLLC

(57) ABSTRACT

A planar magnet speaker with excellent sound reproduction in a low frequency range and capable of providing a plurality of input controls includes a first magnet member, a second magnet member, a membrane including at least one wire formed between the first magnet member and the second magnet member, and a support frame.

20 Claims, 21 Drawing Sheets

(56) References Cited

U.S. PATENT DOCUMENTS 4,228,327 A * 10/1980 Sawafuji ..... H04R 7/20 381/398
4,242,541 A * 12/1980 Ando ..... H04R 9/047 381/182
4,267,405 A 5/1981 Russell
4,471,173 A 9/1984 Winey
4,803,733 A 2/1989 Carver et al.
4,924,504 A * 5/1990 Burton ..... H04R 7/04 381/398
4,939,784 A 7/1990 Bruney
5,003,610 A * 3/1991 Adachi ..... H04R 9/047 381/413
5,748,758 A 5/1998 Menasco, Jr. et al.
6,480,614 B1 * 11/2002 Denda ..... H04R 7/04 381/191
6,760,462 B1 * 7/2004 Thigpen ..... H04R 9/047 381/408
6,934,402 B2 8/2005 Croft, III et al.
6,963,654 B2 * 11/2005 Sotme ..... H04R 7/04 381/399
7,095,864 B1 8/2006 Billson et al.
7,099,488 B2 * 8/2006 Bohlender ..... H04R 7/04 381/408
7,142,688 B2 11/2006 Croft, III et al.
7,174,024 B1 * 2/2007 Suzuki ..... H04R 7/04 381/152
7,181,041 B2 2/2007 Koike
7,283,636 B2 10/2007 Nishimura et al.
7,502,486 B2 3/2009 Shin et al.
RE40,860 E 7/2009 Billson et al.
7,596,237 B1 * 9/2009 Constantin ..... H04R 25/552 318/2
7,929,726 B1 4/2011 Jones
8,031,901 B2 10/2011 Levitsky
8,116,512 B2 * 2/2012 Levitsky ..... H04R 9/025 381/399
8,300,876 B2 10/2012 Xu
8,416,973 B2 4/2013 Medley et al.
8,520,887 B2 8/2013 Simidian, II et al.
8,542,862 B2 * 9/2013 Meguro ..... H04R 7/045 381/396
8,780,673 B2 7/2014 Cohen et al.
8,948,441 B2 * 2/2015 Zhao ..... H04R 7/045 381/398
8,983,112 B2 * 3/2015 Zhao ..... H04R 7/045 381/421
9,099,770 B2 8/2015 Ishizuka et al.
9,258,638 B2 2/2016 Colich
9,287,029 B1 3/2016 Colich
9,288,580 B2 3/2016 Matsumura et al.
9,319,793 B2 * 4/2016 Braho ..... H04R 1/10
9,692,285 B2 * 6/2017 Backes ..... H01F 7/1646
9,955,252 B2 * 4/2018 Colich ..... H04R 3/00
2003/0076977 A1 4/2003 Levitsky
2003/0190052 A1 * 10/2003 Button ..... H04R 9/063 381/401
2005/0220320 A1 * 10/2005 Kim ..... H04R 9/025 381/396
2006/0023902 A1 2/2006 Thigpen
2006/0050923 A1 3/2006 Croft, III et al.
2007/0098207 A1 5/2007 Lin
2007/0127767 A1 6/2007 Croft, III et al.
2007/0217645 A1 9/2007 Ishihara
2010/0278361 A1 11/2010 Simidian, II et al.
2011/0150264 A1 6/2011 Konuma
2011/0200204 A1 8/2011 Horigome et al.
2011/0274309 A1 11/2011 Doh et al.
2012/0051557 A1 * 3/2012 Horigome ..... H04R 9/047 381/86
2012/0057727 A1 3/2012 Yasuda et al.
2014/0140567 A1 * 5/2014 LeBoeuf ..... A61B 5/7221 381/381
2015/0072723 A1 3/2015 Schoffmann et al.
2015/0326974 A1 11/2015 Skubinski, III et al.
2015/0334487 A1 * 11/2015 Bowers ..... H04R 1/40 367/138
2016/0212544 A1 7/2016 Jacques et al.
2018/0132019 A1 * 5/2018 Riedel ..... H04R 9/047
2018/0132041 A1 * 5/2018 Lim ..... H04R 7/04

FOREIGN PATENT DOCUMENTS

JP 3815740 B2 8/2006
JP 2013-219642 A 10/2013
KR 10-0697351 B1 3/2007
KR 10-1419202 B1 7/2014
WO 2005/094120 A1 10/2005

OTHER PUBLICATIONS

Communication dated May 16, 2019, issued by the European Patent Office in counterpart European Application No. 17866670.7.

* cited by examiner

PLANAR MAGNET SPEAKER

CROSS-REFERENCE TO RELATED APPLICATION

This application claims priority from Korean Patent Application No. 10-2016-0146907, filed on Nov. 4, 2016, in the Korean Intellectual Property Office, the disclosure of which is incorporated herein in its entirety by reference.

BACKGROUND

1. Field

One or more exemplary embodiments of the present disclosure relates to speakers, and more particularly, one or more exemplary embodiments of the present disclosure relates to planar magnet speakers.

2. Description of the Related Art

In recent years, there has been an increasing demand for a speaker having a small thickness in order to be mounted on a thin film type display.

When a single-coil speaker or a multi-coil speaker operates, a voice coil located on a diaphragm makes the entire diaphragm vibrate. Coil-type speakers may output high-volume sound, but they are not suitable for use as thin speakers because they have a great thickness.

To manufacture a thin speaker, instead of using a coil, an electrostatic transducer may be implemented using a piezoelectric plate or an electrostatic plate that responds to an electric field. However, the electrostatic transducer may require a very high driving voltage in relation to an output sound volume and may perform a bending motion rather than a piston motion. Thus, the electrostatic transducer can output only low-volume sound and has insufficient reproduction performance in a low frequency range.

Therefore, a planar magnet speaker that may be easily manufactured to have a small thickness and generate sound through a piston movement of a membrane is needed.

SUMMARY

Provided are planar magnet speakers that have excellent sound reproduction in a low-frequency range.

Provided are planar magnet speakers capable of preventing power loss due to a carrier phase.

Provided are planar magnet speakers capable of controlling vibration for each partition area of a membrane.

Provided are planar magnet speakers capable of controlling vibration for each layer of a membrane.

Additional aspects will be set forth in part in the description which follows and, in part, will be apparent from the description, or may be learned by practice of the presented exemplary embodiments.

According to an aspect of an exemplary embodiment, there is provided a planar magnet speaker comprising: a first magnet member comprising a plurality of first magnets, the plurality of first magnets being concentrically disposed, a second magnet member spaced apart from the first magnet member and comprising a plurality of second magnets, the plurality of second magnets being concentrically disposed and a membrane provided between the first magnet member and the second magnet member and comprising one or more wires, wherein the membrane is configured to generate sound according to a signal applied to the one or more wires.

The first magnet member may be formed on a first plane, and

The second magnet member may be formed on a second plane, which is parallel to the first plane, and is spaced apart from the first magnet member.

A third magnet, among the plurality of first magnets, may have a same shape as a fourth magnet, among the plurality of first magnets.

A third magnet, among the plurality of first magnets, may have a first region having an outer boundary and an inner boundary, and a fourth magnet, among the plurality of first magnets, may have a second region having an outer boundary and an inner boundary.

The second region may be provided inside the inner boundary of the third magnet.

The planar magnet speaker may further comprise a support frame configured to support the first magnet member, the second magnet member, and the membrane.

The membrane may be further configured to generate the sound by vibrating the membrane based on the signal applied to the one or more wires.

Each of the plurality of first magnets may be arranged at regular intervals from one another.

The second magnet member may be symmetrically arranged with respect to the first magnet member.

The plurality of first magnets may be arranged to have alternate polarities, and the plurality of second magnets may be arranged to form a repulsion magnetic field with the plurality of first magnets.

Signals having different phases may be applied to the one or more wires.

The membrane may further comprise a pattern area in which the one or more wires are provided.

The one or more wires may comprise a first wire and a second wire, wherein a first current having a first phase passes through the first wire, and a second current having a second phase different from the first phase passes through the second wire.

The first wire may be configured to form a loop in the pattern area, and the second wire may be configured to form a separate loop from the first wire in the pattern area.

The planar magnet speaker may further comprise: at least one switch configured to switch connections between the one or more wires for adjusting an impedance of the planar magnet speaker.

The membrane may further comprise a first layer membrane and a second layer membrane in a stack structure, and wherein a first wire, among the one or more wires, may be provided in the first layer membrane and a second wire, among the one or more wires, may be provided in the second layer membrane.

The membrane may be divided into a plurality of partition areas, and each of the partition areas may comprise at least one wire, among the one or more wires, that forms a separate loop in the respective partition area.

The support frame may comprise a first magnet frame for supporting the first magnet member and a second magnet frame for supporting the second magnet member.

The support frame may further comprise a spacing frame provided between the first magnet frame and the second magnet frame to separate the first magnet frame and the second magnet frame by a predetermined distance.

The support frame may further comprises an edge member provided between the spacing frame and the membrane to support the membrane, wherein the edge member may be coupled along a periphery of the membrane.

The planar magnet speaker may further comprise a cover provided on one surface of the first magnet member or the second magnet member, wherein the cover has a mesh structure.

Each of the first magnet member and the second magnet member may have one of a circular shape having a first outer boundary and a first inner boundary, an elliptical shape having a third outer boundary and a fourth inner boundary, a rectangular shape having a fifth outer boundary and a sixth inner boundary and a polygon shape having a seventh outer boundary and an eight inner boundary.

The plurality of first magnets and the plurality of second magnets may form a rectangular shape having an outer boundary and an inner boundary, The planar magnet speaker may further comprise at least one first linear magnet spaced apart by a first distance from a first magnet located at an outermost position among the plurality of first magnets and a second linear magnet spaced apart by a second distance from a second magnet located at an outermost position among the plurality of second magnets, wherein the first linear magnet may be arranged to form a repulsive magnetic field with the second linear magnet.

The planar magnet speaker may further comprise a third magnet member on the first plane and comprising a plurality of third magnets having same shape and different sizes and a fourth magnet member on the second plane spaced apart from the first plane in a perpendicular direction and comprising a plurality of fourth magnets having same shape and different sizes, wherein the plurality of third magnets may be arranged to form a repulsion magnetic field with the plurality of fourth magnets, wherein the first magnet member and the second magnet member may form a concentric structure with respect to a first central axis, and the plurality of third magnets and the plurality of fourth magnets form a concentric structure with respect to a second center axis spaced apart from the first central axis, and wherein the support frame may support the third magnet member and the fourth magnet member.

According to an aspect of an exemplary embodiment, there is provided a planar magnet speaker device comprising: a first magnet member comprising a first magnet and a second magnet, a second magnet member comprising a third magnet and a fourth magnet and a membrane provided in a gap between the first magnet member and the second magnet member and comprising at least one wiring pattern, wherein each of the first, the second, the third and the fourth magnets have an annular shape or a polygonal shape.

Each of the first magnet, second magnet, third magnet and the fourth magnet may have a region having an outer boundary and an inner boundary.

The second magnet may be provided inside the inner boundary of the first magnet.

The fourth magnet may be provided inside the inner boundary of the third magnet.

The first magnet may have a first polarity facing the membrane and the second magnet may have a second polarity facing the membrane, the first polarity being different from the second polarity.

The first magnet may have a first polarity facing the membrane and the third magnet have a second polarity facing the membrane, the first polarity being different from the second polarity, wherein the first magnet is configured to form a repulsion magnetic field with the third magnet.

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
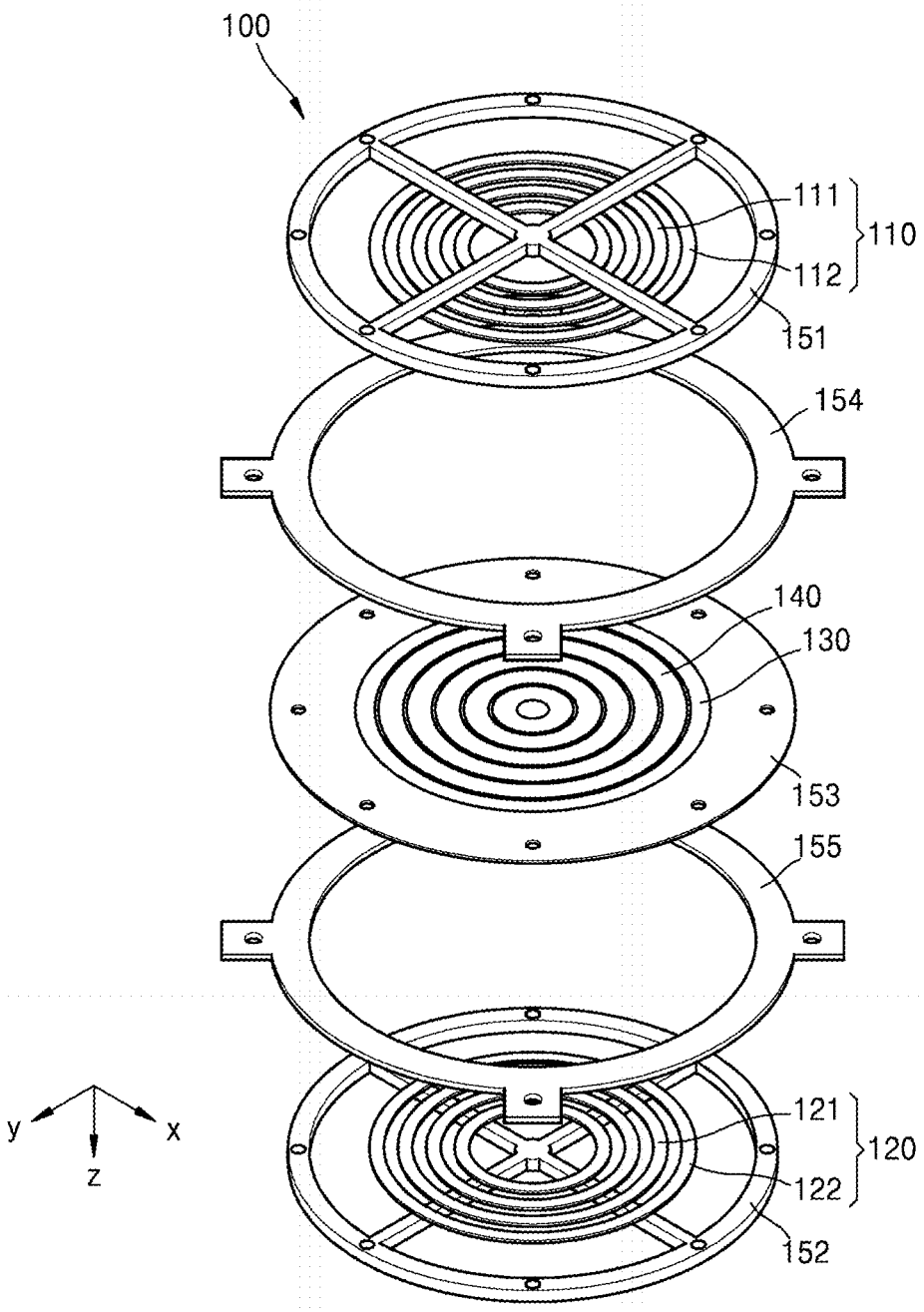
FIG. 1 is an exploded perspective view of a planar magnet speaker according to an exemplary embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects.

Like reference numerals refer to like elements throughout. In the drawings, the sizes of constituent elements may be exaggerated for clarity. It will be understood that, although the terms first, second, etc. may be used herein to describe various elements, these elements should not be limited by these terms. These terms are only used to distinguish one element from another.

As used herein, the singular forms "a", "an", and "the" are intended to include the plural forms as well, unless the context clearly indicates otherwise. In addition, it will be understood that when a unit is referred to as "comprising" another element, it may not exclude the other element but may further include the other element unless specifically oppositely indicates.

Figure 2A:
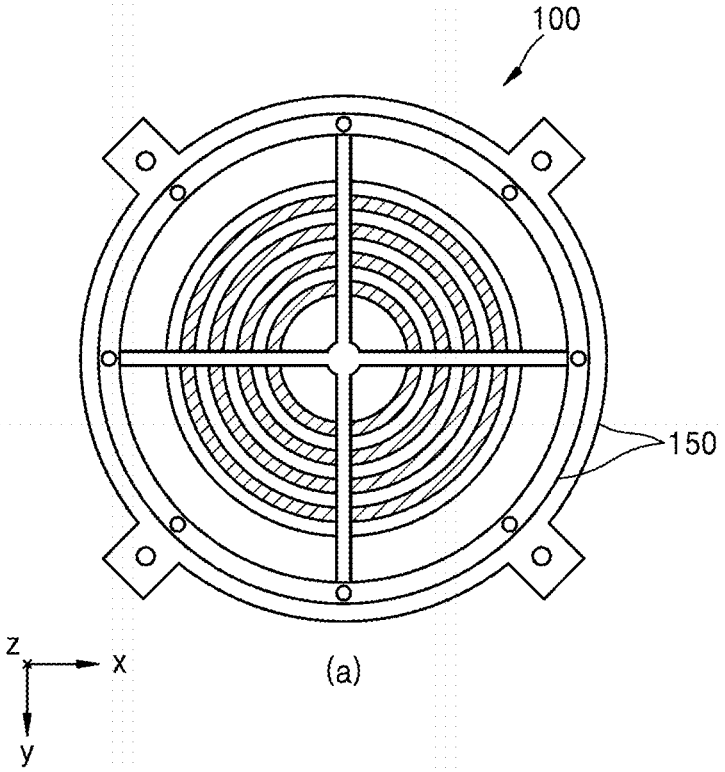
FIGS. 2A and 2B are respectively a plan view and a side view of the planar speaker shown in FIG. 1 according to an exemplary embodiment.
Figure 2B:
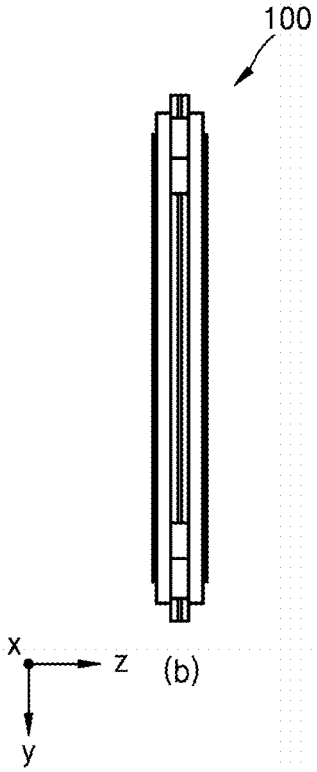
Figure 3:
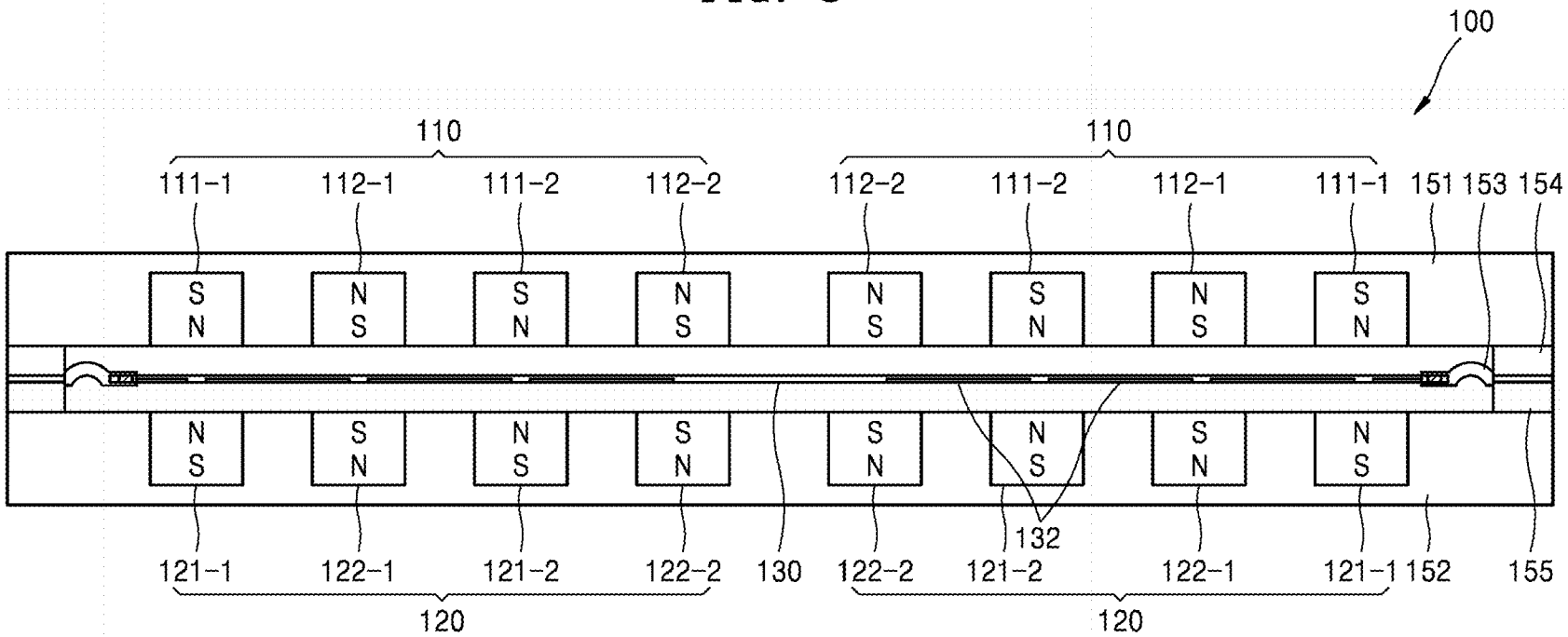
FIG. 3 is a schematic cross-sectional view of the planar speaker shown in FIG. 1 according to an exemplary embodiment.

FIG. 1 is an exploded perspective view of a planar magnet speaker 100 according to an exemplary embodiment. FIGS. 2A and 2B are respectively a plan view and a side view of the planar speaker 100 shown in FIG. 1 according to an exemplary embodiment. FIG. 3 is a schematic cross-sectional view of the planar speaker 100 shown in FIG. 1 according to an exemplary embodiment.

Referring to FIGS. 1 to 3, the planar magnet speaker 100 may include a first magnet member 110, a second magnet member 120, a membrane 130 between the first magnet member 110 and the second magnet member 120, at least one electric wire 140 on the membrane 130, and a support frame 150.

Referring to FIG. 1, the first magnet member 110 may be arranged to be parallel to an x-y plane. The first magnet member 110 may include a plurality of first magnets 111 and 112, (i.e., first magnets 111-1, 111-2, 112-1 and 112-2 illustrated in FIG. 3), that are periodically spaced apart from each other on a first plane. Although four magnets are illustrated in FIGS. 1-3 according to an exemplary embodiment, the number of magnets may vary according to other exemplary embodiments. Each of the plurality of first magnets 111 and 112 may be a magnetic body having N poles and S poles at respective ends with respect to a vertical direction (a z-axis direction). The plurality of first magnets 111 and 112 may include a first magnet 111 having a first pole facing the membrane 130 and a second magnet 112 having a second pole opposite to the first pole facing the membrane 130. For example, the magnet 111-1 may be provided such that the N pole faces the membrane 130, and the magnet 112-1 may be provided such that the S pole faces the membrane 130. The plurality of first magnets 111 and 112 may have alternating polarities. The plurality of first magnets 111 and 112 may have a shape having a space inside when viewed from a vertical direction. For example, the plurality of first magnets 111 and 112 may have any one of a circular shape having a space therein, an ellipse having a space therein, a square having a space therein, and a polygonal shape having a space therein. For example, the plurality of first magnets 111 and 112 may have a region surrounded by two concentric circles, a region surrounded by two concentric squares, or a region having a rectangular outer boundary and a rectangular inner boundary, or a region having an outer boundary and an inner boundary. The plurality of first magnets 111 and 112 may have a three-dimensional shape having a hollow center. For example, the plurality of first magnets 111 and 112 may have various three-dimensional shapes having a hollow center such as a ring, a hoop, a band and the like. When each of the plurality of first magnets 111 and 112 have a ring shape, a cross-sectional shape of the ring in the vertical direction may not be particularly limited. For example, the cross-sectional shape of the ring in the vertical direction may be any one of circular, elliptical, rectangular, and polygonal shapes. The shapes of the plurality of first magnets 111 and 112 are not limited to the above-described embodiment and may have various shapes.

According to an embodiment, the first magnet member 110 may include four first magnets 111 and 112, but is not limited thereto. The plurality of first magnets 111 and 112 may be spaced apart from each other by a predetermined distance. According to an exemplary embodiment, the plurality of first magnets 111 and 112 may be spaced apart from each other at regular intervals. For example, the plurality of first magnets 111 and 112 may be spaced apart from each other by a first distance.

For example, the magnets 111-1 and 111-2 may be spaced apart from each other by twice the first distance. For example, the magnets 112-1 and 112-2 may be spaced apart from each other by twice the first distance. When a spaced distance between the plurality of first magnets 111 and 112 is constant, an intensity of a magnetic field is uniform, and high-quality sound may be generated. The plurality of first magnets 111 and 112 may have a concentric structure with respect to a first central axis in the z-axis direction. The concentric structure may refer to a structure in which components are spaced at equal intervals with respect to one central axis.

According to another exemplary embodiment, the plurality of first magnets 111 and 112 may be spaced apart from each other by a varying intervals.

Referring to FIG. 3, the second magnet member 120 may include a plurality of second magnets 121 and 122, (i.e., second magnets 121-1, 121-2, 122-1 and 122-2), periodically spaced on a second plane perpendicularly spaced from the first plane. According to an exemplary embodiment, both the first plane and the second plane may be parallel to the x-y plane. The plurality of second magnets 121 and 122 may be a magnetic body having N poles and S poles at both ends with respect to the vertical direction (z-axis direction). The second magnet member 120 may be arranged to form a repulsive magnetic field with the first magnet member 110. For example, the magnet 111-1 and the magnet 121-1 may face each other so that polarities thereof form a repulsive force with each other in the vertical direction. For example, the magnet 112-1 and the magnet 122-1 may face each other so that a repulsive force is formed in the vertical direction due to opposite polarities thereof. The plurality of second magnets 121 and 122 may have a circular shape having a space therein, an ellipse having a space therein, a square having a space therein, or a polygonal shape having a space therein. For example, the plurality of first magnets 121 and 122 may have a region surrounded by two concentric circles, a region surrounded by two concentric, squares, or a region having a rectangular outer boundary and a rectangular inner boundary, or a region having an outer boundary and an inner boundary. The plurality of first magnets 121 and 122 may have a three-dimensional shape having a hollow center. For example, the plurality of first magnets 121 and 122 may have various three-dimensional shapes having a hollow center such as a ring, a hoop, a band and the like. When the plurality of first magnets 121 and 122 have a ring shape, a cross-sectional shape of the ring in the vertical direction may not be particularly limited. For example, the cross-sectional shape of the ring in the vertical direction may be any one of circular, elliptical, rectangular, and polygonal shapes. The shapes of the plurality of second magnets 121 and 122 are not limited to the above-described embodiment, and may have various shapes. For example, the plurality of second magnets 121 and 122 and the plurality of first magnets 111 and 112 may have the same shape. According to an exemplary embodiment, each of the first magnets, 111 and 112, and the second magnets, 121 and 122 have an annular shape or a polygonal shape.

The membrane 130 may be provided between the first magnet member 110 and the second magnet member 120. Referring to FIG. 1, a shape of the membrane 130 may be circular, but is not limited thereto. The shape of the membrane 130 may have various shapes that may secure an area for obtaining a desired sound output. The membrane 130 is configured to generate the sound by vibrating the membrane 130 based on the signal applied to the at least one electric wire 140. For example, the shape of the membrane 130 may be circular, angular, rectangular, polygonal, or the like. For example, the membrane 130 may be a printed circuit board (PCB) membrane. The membrane 130 may vibrate between the first magnet member 110 and the second magnet member 120 and may generate sound. The sound generated in the membrane 130 may be spread out through a gap between the plurality of first magnets 111 and 112 and a gap between the plurality of second magnets 121 and 122.

Figure 4:
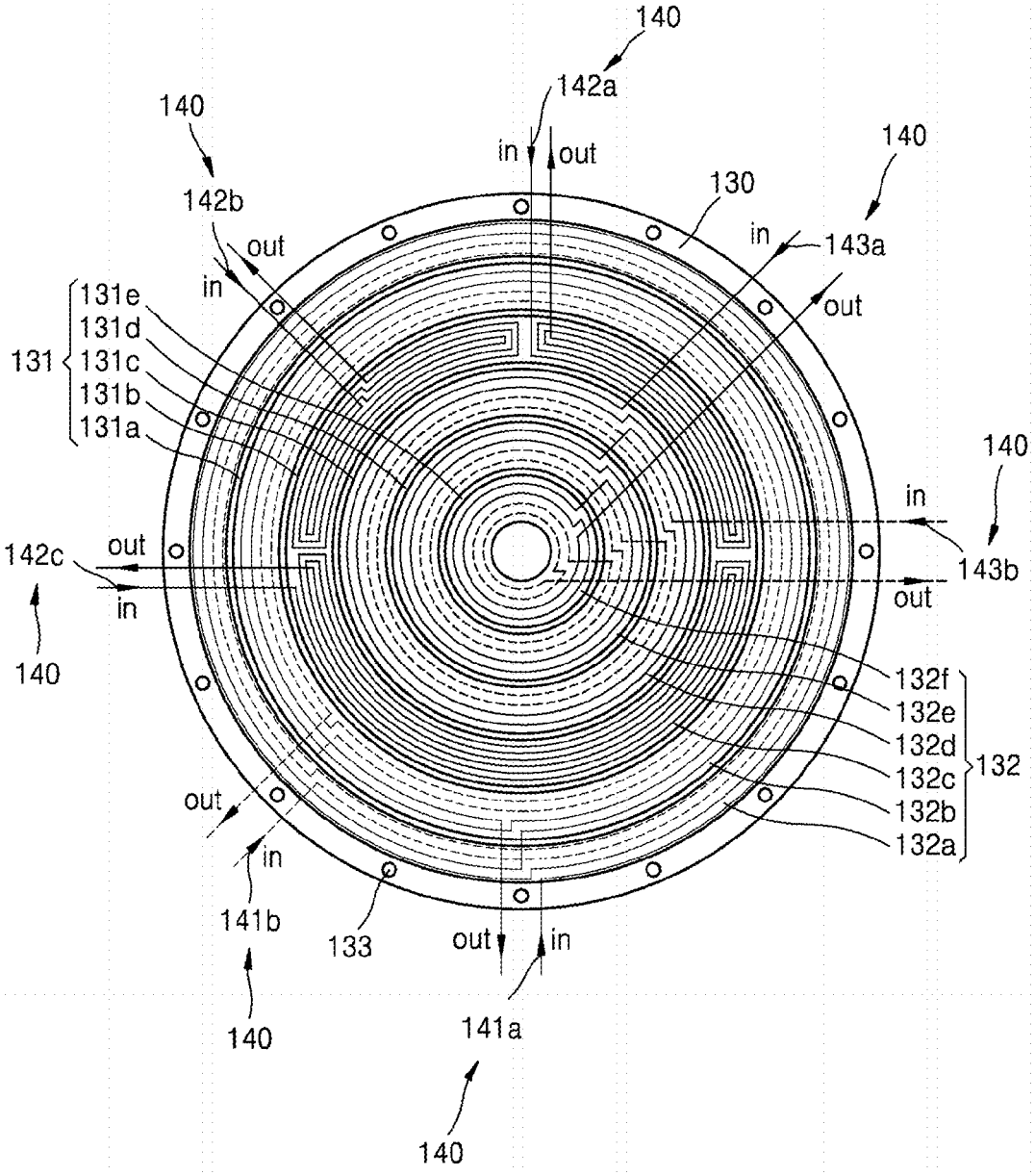
FIG. 4 is a plan view of a membrane and a plurality of electric wires according to an exemplary embodiment.

The membrane 130 may include at least one pattern area. The pattern area according to an exemplary embodiment is illustrated in FIG. 4, and described below in more detail. The pattern area may be a region where the at least one electric wire 140 is provided. The pattern area may be, for example, a plurality of regions provided on the membrane 130 so as to have a concentric structure. For example, the at least one electric wire 140 may be patterned on the pattern area.

The membrane 130 itself may vibrate and produce sound so that the membrane 130 may be formed of a rigid material that is not easily warped or bent, but is not limited thereto. The membrane 130 may be formed of a flexible film material.

The at least one electric wire 140 may be provided on the membrane 130. For example, the electric wire 140 may be provided on the membrane 130, or may be provided within the membrane 130. For example, the at least one electric wire 140 may be patterned on the PCB membrane 130. The at least one electric wire 140 may receive a separate input signal for each electric wire. For example, when a first electric wire and a second electric wire are patterned on the PCB membrane, the first wire may receive a first input signal and the second wire may receive a second input signal. The input signal may include a carrier signal and a sound signal. The electric wire 140 may be an electric wire through which the sound signal and the carrier signal pass. For example, each of the at least one electric wire 140 may be connected to a separate input terminal so that a separate sound signal and a carrier signal may be applied.

The electric wire 140 may be applied with a carrier signal having a different phase. The carrier signal is a signal used to modulate a sound signal. The carrier signal may have a frequency beyond an audible range that is not audible to a person. The carrier signal may have an amplitude to modulate the sound signal. The greater the amplitude of the carrier signal, the greater the unnecessary power loss in the electric wire 140. Accordingly, the electric wire 140 may receive carrier signals having different phases, thereby reducing the power loss due to the carrier signal through a destructive interference due to a phase difference. In order to reduce the power loss, there may be a carrier phase difference in the electric wire 140 passing through the same pattern area of the membrane 130. For example, the carrier phase difference may be at a maximum. According to an exemplary embodiment, when two electric wires 140 pass through the same pattern area of the membrane 130, carrier signals having different carrier phases may be input to the two electric wires 140 to reduce occurrence of power loss in the wires. According to an exemplary embodiment when the carrier phase difference of 180 degrees is obtained, the occurrence of power loss may be reduced even more. A detailed description I regarding different carrier phases may be provided with reference to FIGS. 8 through 14 below.

The electric wires 140 may be positioned so that the carrier signals applied to the respective electric wires may interfere with each other. A degree of adjacency may be determined according to a size of a cross-sectional area of the electric wire 140 and the magnitude of an applied signal. For example, the greater the cross-sectional area of the electric wire 140, or the greater the magnitude of the applied carrier signal, the more likely the carrier signals will interfere with each other even if the electric wire 140 is relatively far away. For example, as the cross-sectional area of the electric wire 140 is smaller and the size of the applied carrier signal is smaller, the electric wires 140 may be located relatively close to each other so that the carrier signals may interfere with each other. For example, the electric wires 140 may be in contact with each other such that the carrier signals applied to the electric wires 140 may interfere with each other. For example, a gap between the electric wires 140 may be a distance that is several times the cross-sectional area of the electric wire 140 so that the carrier signals applied to the electric wires 140 may interfere with each other.

The electric wires 140 may be located on different partition areas of the membrane 130. The partition area may refer to an area partitioned when the membrane 130 is viewed in a plan view. While the electric wires 140 may receive the same sound signal and different carrier phase signals according to exemplary embodiment, the present disclosure is not limited thereto. According to another exemplary embodiment, at least some of the electric wires 140 may receive separate input signals to vibrate each of the partition areas individually. For example, at least some of the electric wires 140 may receive the same sound signal and different carrier phase signals. In another exemplary embodiment, at least some of the electric wires 140 may receive the same carrier phase signal and different sound signals. In another exemplary embodiment, at least some of the electric wires 140 may receive different phase carrier signals and different sound carrier signals.

Upon dividing the membrane 130 into a first partition area and a partition area, some electric wires of the plurality of electric wires 140 may form at least one loop in the first partition area and the remaining electric wires may form at least one loop in the second partition area. In this case, vibration of the first partition area may be determined by an input signal to the electric wire forming the loop in the first partition area, and vibration of the second partition area may be determined by an input signal to the electric wire forming the loop in the second partition area. A vibration pattern of the membrane 130 may be variously determined by providing the plurality of electric wires 140 to vibrate separate divided regions without vibrating the entire membrane 130 with a single electric wire, a length of an electric wire and impedance may also be determined in various ways. A sound band characteristic may be adjusted by dividing the membrane 130 into separate partition areas and controlling individual vibration. Further, by dividing the membrane 130 into individual separate partition areas and controlling individual vibration, force applied to each partition area may be controlled. For example, even if a movement of the membrane 130 is distorted due to external factors, a difference in vibration for each partition area may be generated to compensate for a vibration difference due to distortion. For example, when vibration is intentionally weighted against a particular partition area of the membrane 130, each control signal may be applied to each of the plurality of electric wires 140 to generate the difference in the vibration for each partition area. A detailed description regarding a manner of compensating for a vibration difference due to distortion may be provided with reference to FIGS. 8 through 14 below.

The support frame 150 may support the first magnet member 110, the second magnet member 120, and the membrane 130. The support frame 150 may include a first magnet frame 151 for supporting the first magnet member 110 and a second magnet frame 152 for supporting the second magnet member 120.

Referring to FIG. 1, the first magnet frame 151 may have a structure for supporting the first magnet member 110, while preventing the sound emitted through the first magnet member 110 from being blocked. For example, the first magnet frame 151 may include two frame bars intersecting each other and a circular frame connected to the two frame bars. The two intersecting frame bars may hold the first magnet member 110 and the circular frame may be combined with remaining components of the support frame 150. The structure of the first magnet frame 151 shown in FIGS. 1 and 2 is only an embodiment and is not limited to the illustrated shape. For example, the first magnet frame 151 may include a plurality of frame bars intersecting with each other and a frame connected to the plurality of frame bars. The frame may have various shapes such as a circle, an ellipse, a rectangle, or a polygon.

The second magnet frame 152 may support the second magnet member 120. The second magnet frame 152 may have the same structure as that of the first magnet frame 151, and thus a detailed description thereof will be omitted.

The support frame 150 may include an edge member 153 that supports the membrane 130. The edge member 153 may be coupled along a periphery of the membrane 130. The edge member 153 may support an outer periphery of the membrane 130 to the support frame 150 so that the membrane 130 vibrates between the first magnet member 110 and the second magnet member 120. According to an exemplary embodiment the edge member 153 may be coupled along the periphery of the membrane 130 using adhesives.

The support frame 150 may include spacing frames 154 and 155 that separate the first magnet member 110 and the second magnet member 120 at a predetermined interval. Referring to FIG. 1, the first spacer frame 154 and the second spacer frame 155 may be fixed by interposing an edge of the edge member 153 therebetween. The first spacer frame 154 may be located between the first magnet frame 151 and the edge member 153. The second spacer frame 155 may be located between the second magnet frame 152 and the edge member 153. Referring to FIG. 1, the spacing frames 154 and 155 are illustrated as separate members, but are not limited thereto and may be integral. Also, the first magnet frame 151, the spacing frames 154 and 155, and the second magnet frame 152 may be integral.

According to an exemplary embodiment, the support frame 150 may include fasteners to secure the first magnet member 110, the second magnet member 120 and the membrane 130. According to another exemplary embodiment, adhesives may be used to secure the first magnet member 110, the second magnet member 120 and the membrane 130.

Referring to FIGS. 2A and 2B, a width of the planar magnet speaker 100 in the x-y plane may be longer than a thickness in the z-axis direction. For example, the width of the planar magnet speaker 100 in the x-y plane may be several to tens of times longer than the thickness in the z-axis direction. A planar shape may mean that the width of the planar magnet speaker 100 in the x-y plane is longer than the thickness in the z-axis direction.

FIG. 4 is a plan view of the membrane 130 and the plurality of electric wires 140 according to an exemplary embodiment.

Referring to FIG. 4, the membrane 130 may include pattern areas 132 in which a plurality of electric wires 140 may be provided. The pattern areas 132 may have the same or similar concentric structure as the plurality of first magnets (111 and 112 in FIG. 1) and the plurality of second magnets (121 and 122 in FIG. 2). The pattern areas 132 may have the same or similar shape obtained by orthogonally projecting the plurality of first magnets (111 and 112 in FIG. 1) or the plurality of second magnets (121 and 122 in FIG. 2) onto the membrane 130 in a vertical direction (z direction). The pattern areas 132 may be repeated with a gap 131 interposed therebetween. A position of the gap 131 may overlap at least a part with an orthogonal shape formed by projecting the plurality of first magnets 111 and 112 or the plurality of second magnets 121 and 122 onto the membrane 130.

The pattern area 132 according to the present exemplary embodiment may include a first pattern area 132*a*, a second pattern area 132*b*, a third pattern area 132*c*, a fourth pattern area 132*d*, a fifth pattern area 132*e*, and a sixth pattern area 132*f* in a direction of a central axis of a concentric structure. The first pattern area 132*a*, the second pattern area 132*b*, the third pattern area 132*c*, the fourth pattern area 132*d*, the fifth pattern area 132*e*, and the sixth pattern area 132*f* may be spaced apart from each other at regular intervals. For example, a first gap 131*a*, a second gap 131*b*, a third gap 131*c*, a fourth gap 131*d*, and a fifth gap 131*e* may be positioned in the direction of the central axis of the concentric structure between the pattern areas 132. The pattern areas 132 and the gaps 131 are only an exemplary embodiment and are not limited thereto.

The plurality of electric wires 140 may include an electric wire 141*a*, an electric wire 141*b*, an electric wire 142*a*, an electric wire 142*b*, an electric wire 142*c*, an electric wire 143*a*, and an electric wire 143*b*. The electric wire 141*a*, the electric wire 141*b*, the electric wire 142*a*, the electric wire 142*b*, the electric wire 142*c*, the electric wire 143*a*, and the electric wire 143*b* may be connected to separate input terminals so that a sound signal and a carrier signal may be respectively applied. A configuration of specific electric wires included in the plurality of electric wires 140 is only an embodiment and is not limited thereto.

The electric wire 141*a* and the electric wire 142*b* may be provided in the first pattern area 132*a* and the second pattern area 132*b*. For example, the electric wire 141*a* and the electric wire 142*b* may form at least one loop in the first pattern area 132*a* and the second pattern area 132*b*. For example, a carrier signal having a carrier phase may be applied to the electric wire 141*a*, a carrier signal having a carrier phase may be applied to the electric wire 142*b*, and the carrier phase and the carrier phase may be different from each other. The electric wire 141*a* and the electric wire 142*b* may be provided in the first pattern area 132*a* so as to be adjacent to each other so that the carrier signals thereof may interfere with each other. The electric wire 141*a* and the electric wire 142*b* may be provided the second pattern area 132*b* so as to be adjacent to each other such that the carrier signals thereof may interfere with each other.

The electric wire 142*a*, the electric wire 142*b*, the electric wire 142*c* may be provided in the third pattern area 132*c*. For example, the electric wire 142*a*, the electric wire 142*b*, the electric wire 142*c* may be provided in different partition areas of the third pattern area 132*c*. For example, the electric wire 142*a*, the electric wire 142*b*, the electric wire 142*c* may form at least one loop in each partition area. For example, the partition areas where the electric wire 142*a*, the electric wire 142*b*, the electric wire 142*c* are provided may not overlap each other.

The electric wire 143*a* and the electric wire 143*b* may be provided in the fourth pattern area 132*d*, the fifth pattern area 132*d*, and the sixth pattern area 132*e*. Carrier signals having different carrier phases may be applied to the electric wire 143*a* and the electric wire 143*b*. The electric wire 143*a* and the electric wire 143*b* may be provided so as to be adjacent to each other such that the carrier signals thereof may interfere with each other.

At least one transmission hole 133 may be provided in an outer portion of the membrane 130. The membrane 130 may be engaged with the edge member (153 in FIG. 5) through the transmission hole 133.

Figure 5:
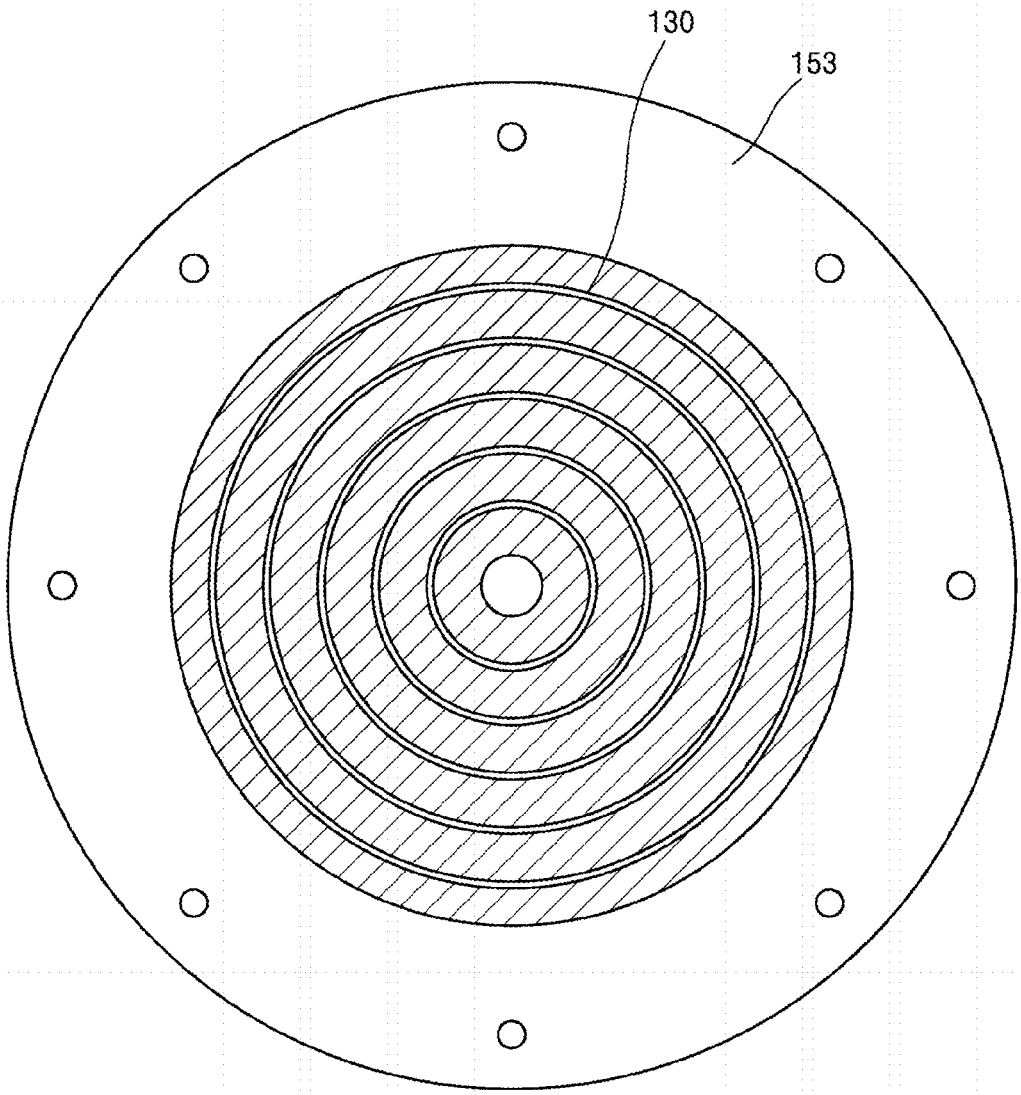
FIG. 5 is a vertical plan view of the membrane and an edge member of FIG. 4 in a combined state according to an exemplary embodiment.

FIG. 5 is a vertical plan view of the membrane 130 and the edge member 153 of FIG. 4 in a combined state.

Referring to FIG. 5, an outer periphery of the membrane 130 may be combined with the edge member 153. The edge member 153 may be formed of an elastic material. For example, the edge member 153 may be formed of a rubber material. For example, the edge member 153 and the membrane 130 may be combined by being cured while the edge member 153 in a liquid rubber state covers the transmission hole (133 in FIG. 4) of the membrane 130.

Figure 6A:
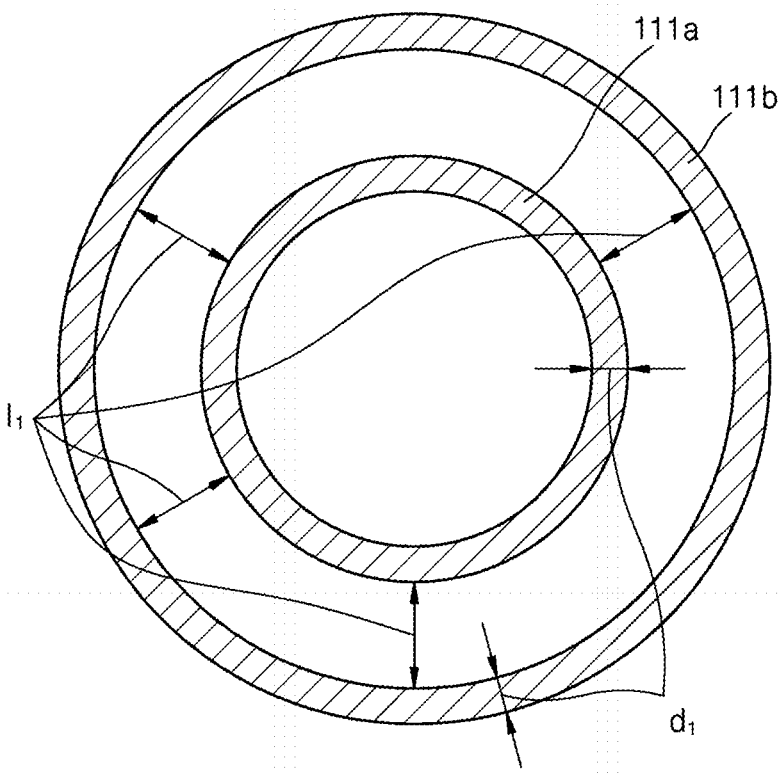
FIGS. 6A to 6C are schematic views of magnets of different shapes according to various exemplary embodiments.
Figure 6B:
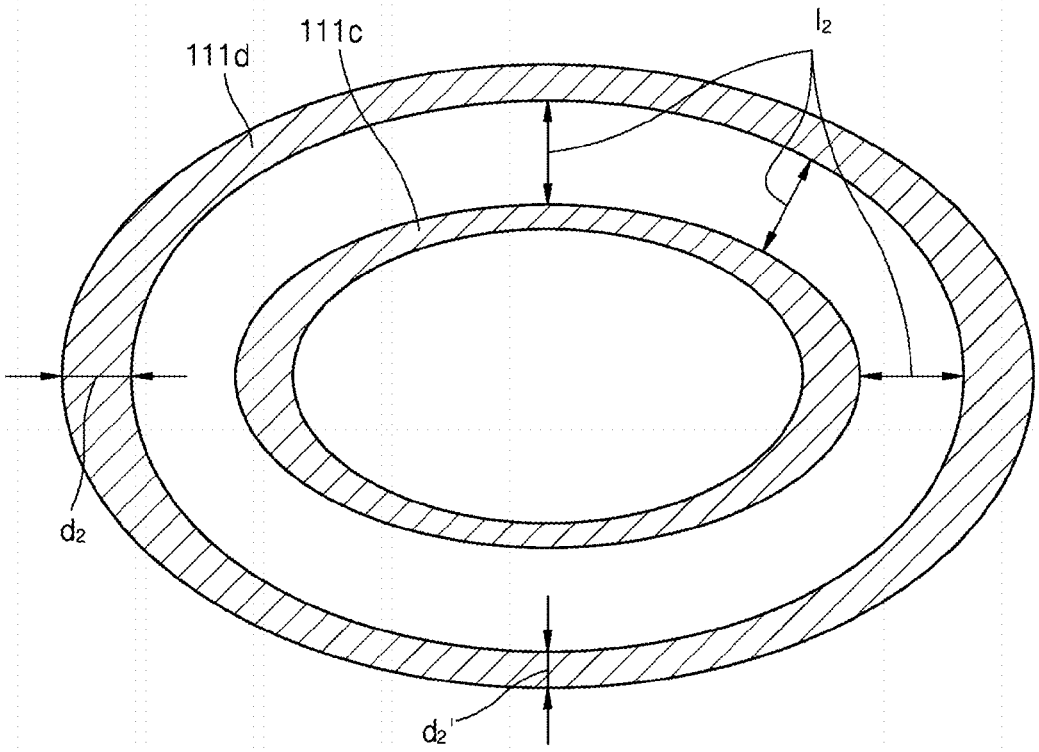
Figure 6C:
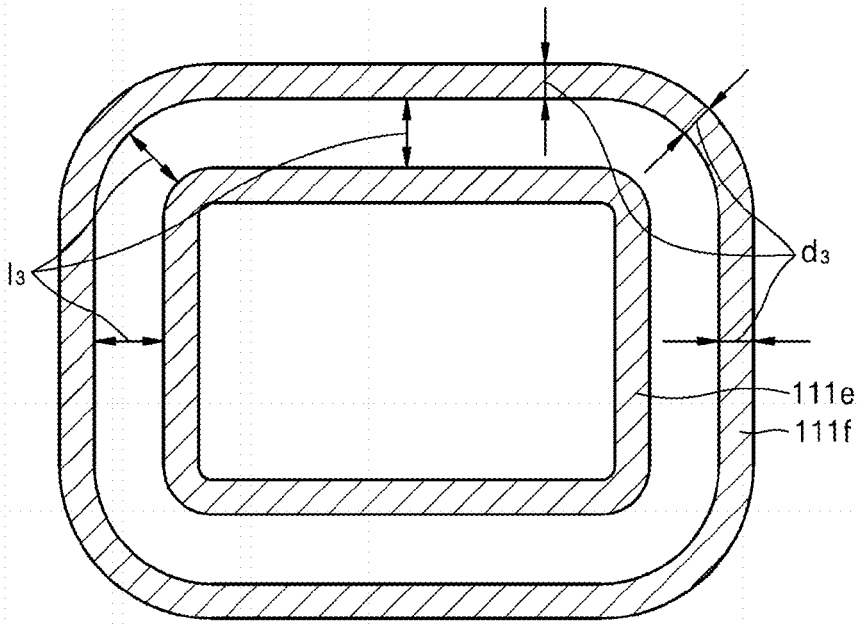

FIGS. 6A to 6C are schematic views of shapes of magnets 111*a*, 111*b*, 111*c*, 111*d*, 111*e*, and 111*f* according to various exemplary embodiments.

Referring to FIG. 6A, the magnets 111*a* and 111*b* may have a circular shape having a space therein. The circular shaped magnets 111*a* and 111*b* having a space inside may have a uniform thickness $d_1$. The circular magnets 111*a* and 111*b* having a space inside may be uniformly spaced from each other by a distance $I_1$.

Referring to FIG. 6B, the magnets 111*c* and 111*d* may have an elliptical shape having a space therein. The magnets 111*c* and 111*d* may be uniformly spaced from each other by a distance $I_2$ of an elliptical shape having a space therein. To this end, the magnets 111*c* and 111*d* may not be uniform in thickness. For example, the magnets 111*c* and 111*d* having an elliptical shape having an internal space may satisfy d2>d2' when a thickness in a major axis direction is $d_2$ and a thickness in a minor axis direction is $d_{2'}$.

Referring to FIG. 6C, the magnets 111*e* and 111*f* may have a rectangular shape having a space therein. The rectangular magnets 111*e* and 111*f* having a space inside may have a uniform thickness $d_3$. The rectangular magnets 111*e* and 111*f* having a space inside may be uniformly spaced from each other by a distance $I_3$. Corners of the rectangular shaped magnets 111*e* and 111*f* having a space therein may be rounded so as to be uniformly spaced from each other.

Figure 7:
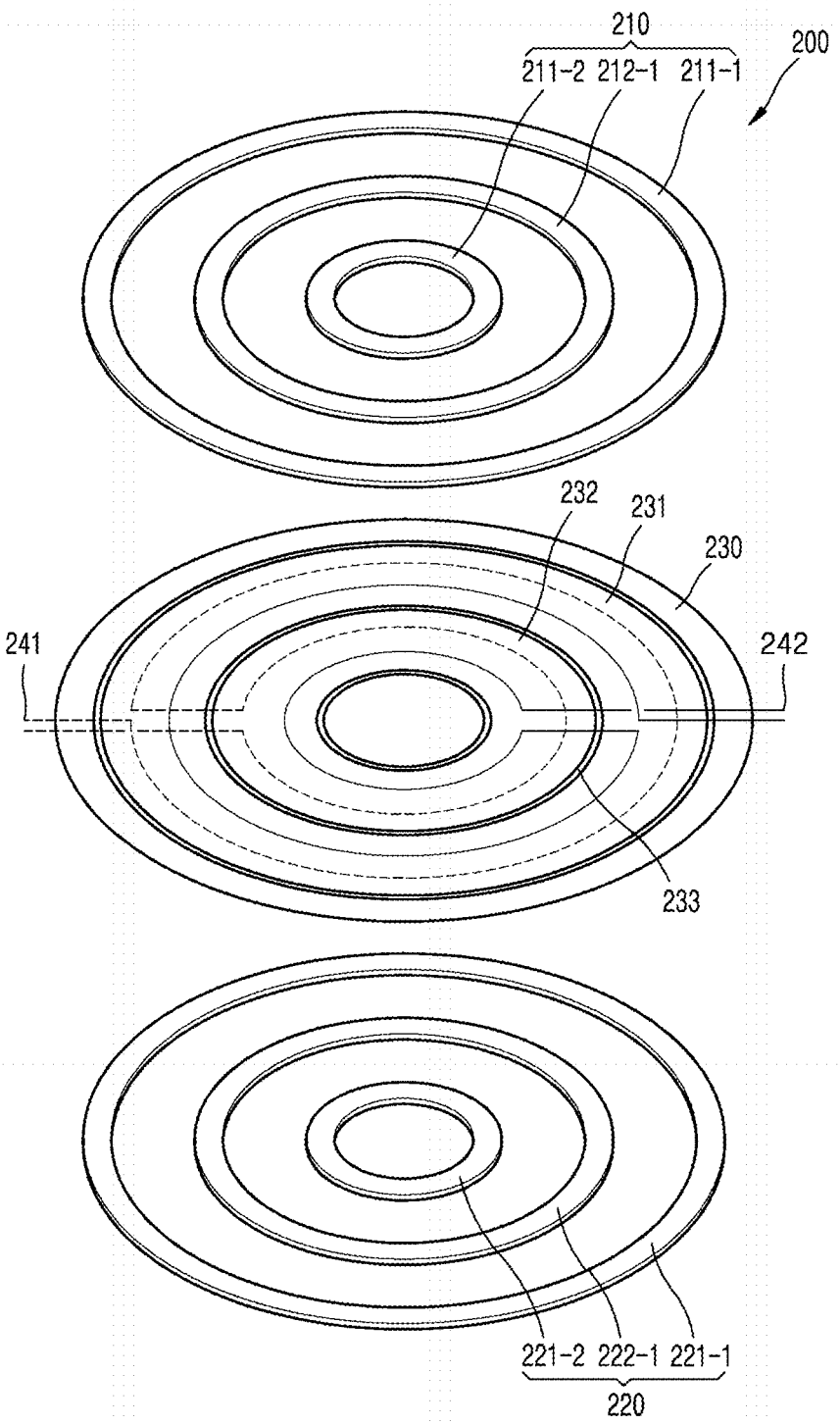
FIG. 7 is a schematic perspective view of a configuration of a planar magnet speaker according to another exemplary embodiment.
Figure 8:
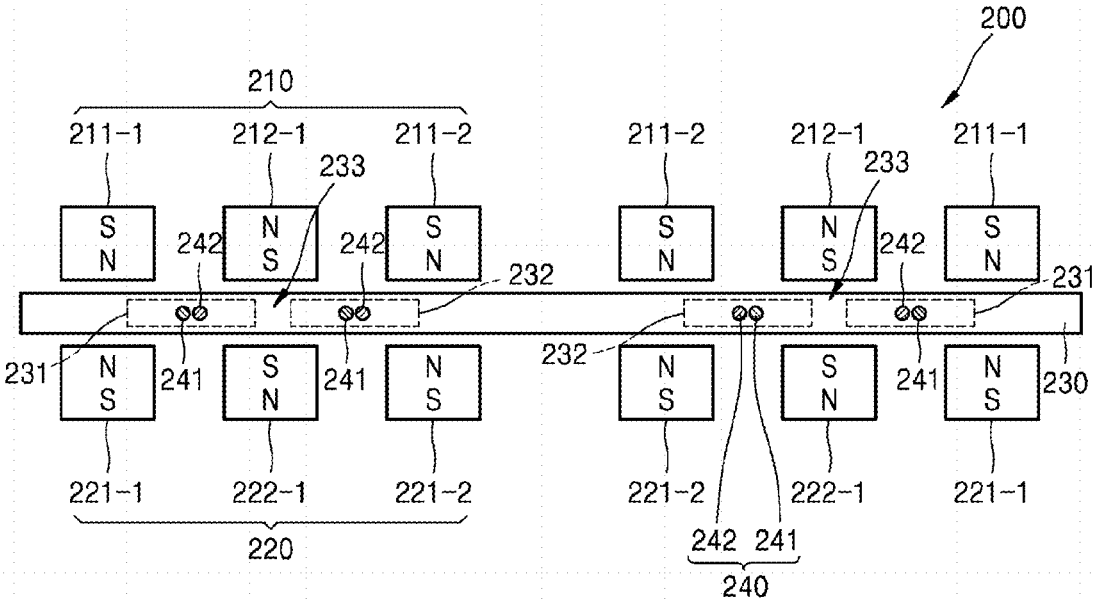
FIG. 8 is a sectional view of the planar magnet speaker of FIG. 7 according to an exemplary embodiment.

FIG. 7 is a schematic perspective view of a configuration of a planar magnet speaker 200 according to another embodiment. FIG. 8 is a sectional view of the planar magnet speaker 200 of FIG. 7.

Referring to FIGS. 7 and 8, a first magnet member 210 may include a magnet 211-1, a magnet 212-1 and magnet 211-2, alternately arranged from the outermost portion. A polarity of the magnet 211-1 toward the membrane 230 and a polarity of the magnet 212-1 toward the membrane 230 may be opposite to each other. The second magnet member 220 may include a magnet 221-1, magnet 222-1 and magnet 221-2, alternately arranged from the outermost portion. The magnet 221-1 may be opposed to the magnet 211-1 at opposite polarities. The magnet 222-1 may be opposed to the magnet 212-1 at opposite polarities.

The membrane 230 may include pattern areas 231 and 232 with a gap 233 therebetween. The first pattern area 231 and the second pattern area 232 may form a concentric structure. The first pattern area 231 may be provided around the second pattern area 232.

A plurality of electric wires 240 may be provided in the pattern areas 231 and 232. For example, the plurality of electric wires 240 may include a first electric wire 241 and a second electric wire 242. The plurality of electric wires 240 may be patterned on the pattern areas 231 and 232.

Referring to FIG. 7, the first electric wire 241 may form at least one loop in the first pattern area 231 and may form at least one loop in the second pattern area 232. The second electric wire 242 may form at least one loop in the first pattern area 231 and may form at least one loop in the second pattern area 232. The greater the number of loops of the first electric wire 241, the larger the intensity of vibration in the first pattern area 231. The greater the number of loops of the second electric wire 242, the greater the intensity of vibration in the second pattern area 232. The maximum number of loops that the plurality of electric wires 240 may form in the pattern areas 231 and 232 may be increased as the area of the pattern areas 231 and 232 is wider.

The first electric wire 241 and the second electric wire 242 may each receive carrier signals having different carrier phases. For example, a carrier signal having a first carrier phase may be input to the first electric wire 241, and a carrier signal having a second carrier phase may be input to the second electric wire 242. The first carrier phase and the second carrier phase may be different from each other. For example, the first carrier phase and the second carrier phase may differ by 180 degrees from each other. As the first carrier phase and the second carrier phase are different from each other, the energy loss in the electric wire 240 due to the carrier signal may be reduced. In the pattern areas 231 and 232, the first electric wire 241 and the second electric wire 242 may be positioned adjacent to each other such that the carrier signals may interfere with each other.

Figure 9:
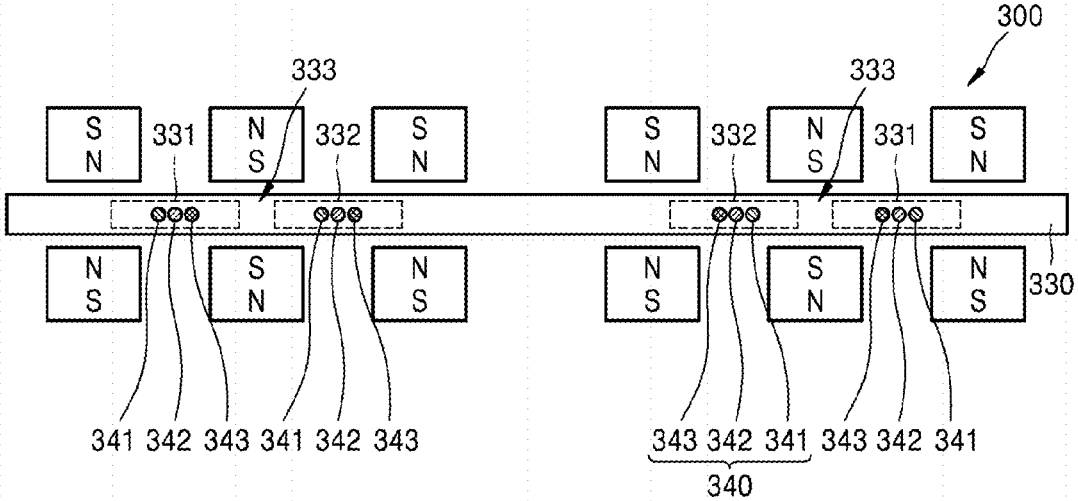
FIG. 9 is a schematic cross-sectional view of a planar magnet speaker according to another exemplary embodiment.

FIG. 9 is a schematic cross-sectional view of a planar magnet speaker 300 according to another exemplary embodiment.

Referring to FIG. 9, the membrane 330 may include pattern areas 331 and 332 in which a plurality of electric wires 340 are provided. The pattern areas 331 and 332 may be separated by a gap 333. The plurality of electric wires 340 may include a first electric wire 341, a second electric wire 342, and a third electric wire 343. The first electric wire 341, the second electric wire 342 and the third electric wire 343 may form at least one loop in the first pattern area 331 and at least one loop in the second pattern area 332. A carrier signal having a first carrier phase may be input to the first electric wire 341. A carrier signal having a second carrier phase may be input to the second electric wire 342. A carrier signal having a third carrier phase may be input to the third electric wire 343. The first carrier phase, the second carrier phase, and the third carrier phase may be different. For example, the first carrier phase and the second carrier phase may differ by 120 degrees from each other, and the second carrier phase and the third carrier phase may differ by 120 degrees from each other. At this time, the energy loss due to the carrier signal may be reduced. The first electric wire 341, the second electric wire 342 and the third electric wire 343 may be positioned adjacent to each other in the pattern areas 331 and 332 so that the carrier signals may interfere with each other.

Figure 10:
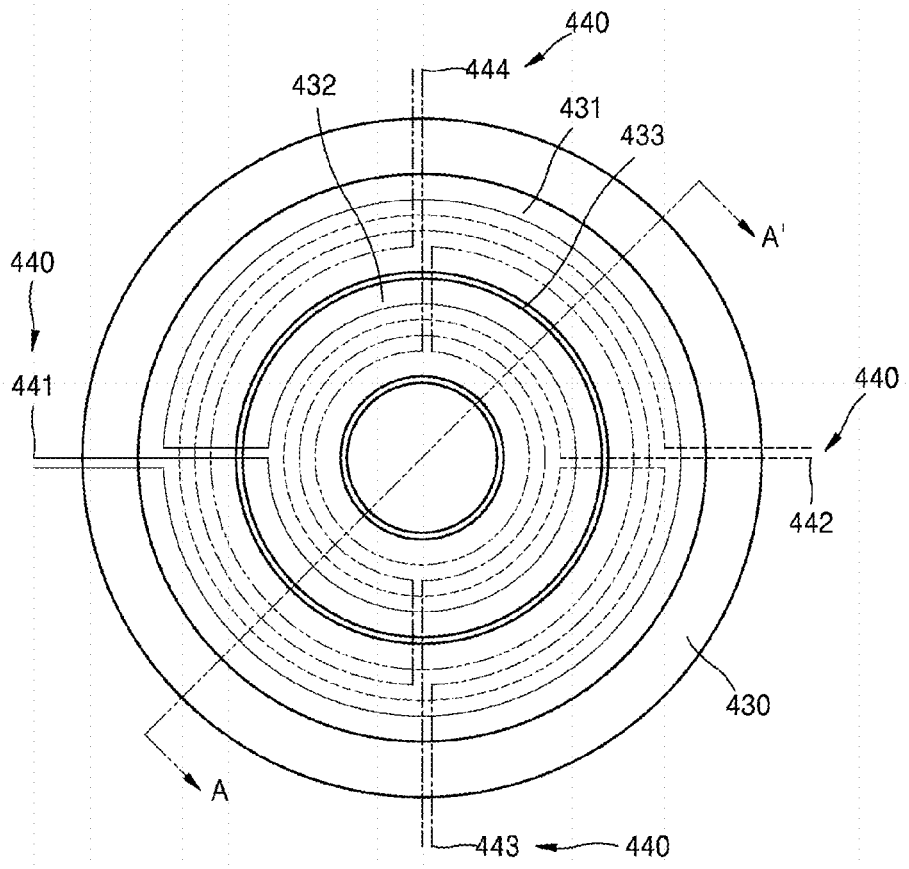
FIG. 10 is a plan view of a membrane included in a planar magnet speaker according to another exemplary embodiment.
Figure 11:
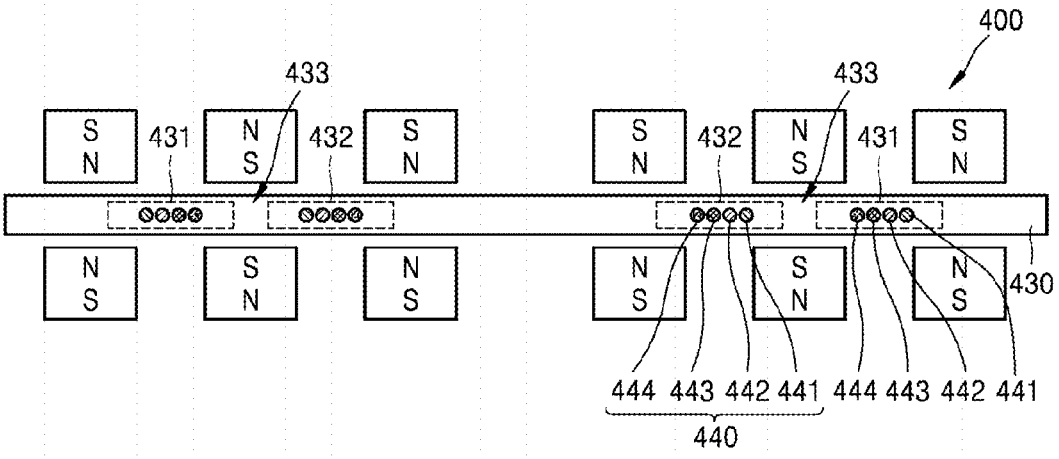
FIG. 11 is a cross-sectional view of the planar magnet speaker of FIG. 10 taken along a line A-A' according to an exemplary embodiment.

FIG. 10 is a plan view of a membrane 430 included in a planar magnet speaker 400 according to another exemplary embodiment. FIG. 11 is a cross-sectional view of the planar magnet speaker 400 of FIG. 10 taken along a line A-A' according to another exemplary embodiment.

The membrane 430 may include pattern areas 431 and 432 in which a plurality of electric wires 440 are provided. The pattern areas 431 and 432 may be separated by a gap 433. The plurality of electric wires 440 may include a first electric wire 441, a second electric wire 442, a third electric wire 443 and a fourth electric wire 444. The first electric wire 441, the second electric wire 442, the third electric wire 443 and the fourth electric wire 444 may form at least one loop in the first pattern area 431 and may form at least one loop the second pattern area 432. A carrier signal having a first carrier phase may be input to the first electric wire 441. A carrier signal having a second carrier phase may be input to the second electric wire 442. A carrier signal having a third carrier phase may be input to the third electric wire 443. A carrier signal having a fourth carrier phase may be input to the fourth electric wire 444.

The first carrier phase, the second carrier phase, the third carrier phase, and the fourth carrier phase may be different from each other. For example, the first carrier phase and the second carrier phase may differ by 90 degrees from each other, the second carrier phase and the third carrier phase may differ by 90 degrees from each other, and the third carrier phase and the fourth carrier phase may differ by 90 degrees from each other. At this time, the energy loss due to the carrier signal may be reduced. The first electric wire 441, the second electric wire 442, the third electric wire 443, and the fourth electric wire 444 may be positioned adjacent to each other such that the carrier signals may interfere with each other.

Figure 12:
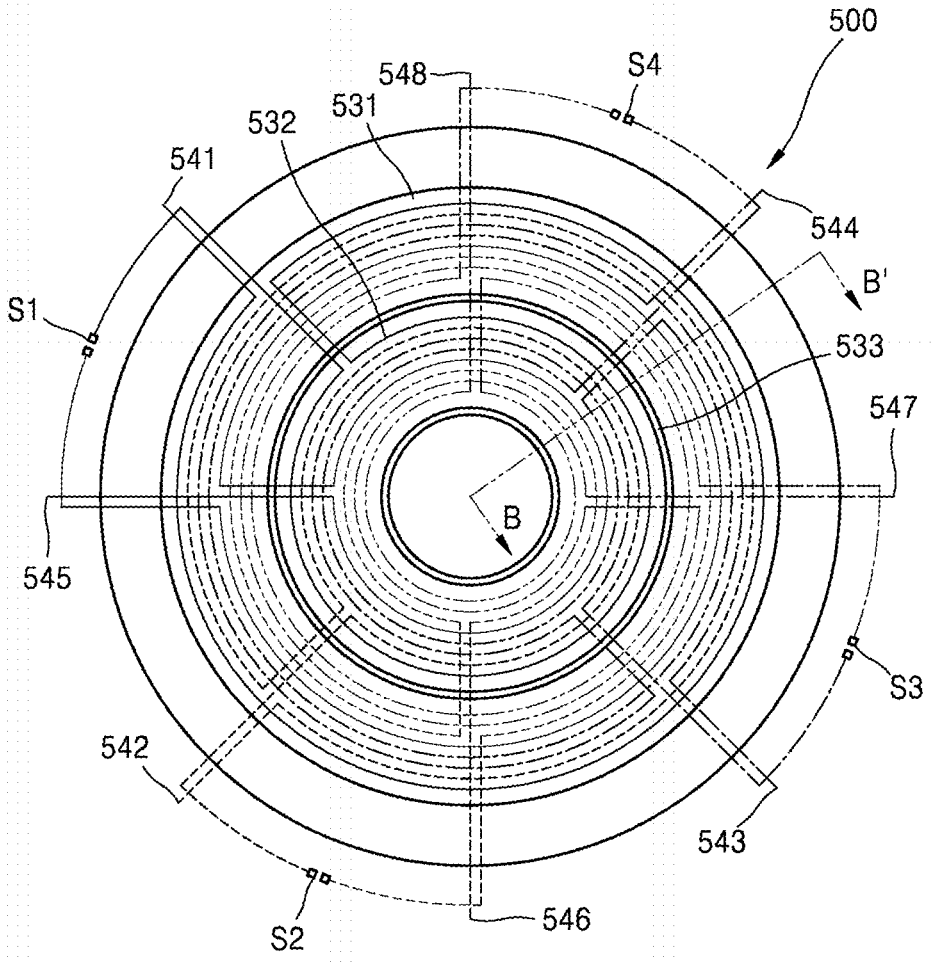
FIG. 12 is a plan view of a membrane 530 included in a planar magnet speaker according to another exemplary embodiment.
Figure 13:
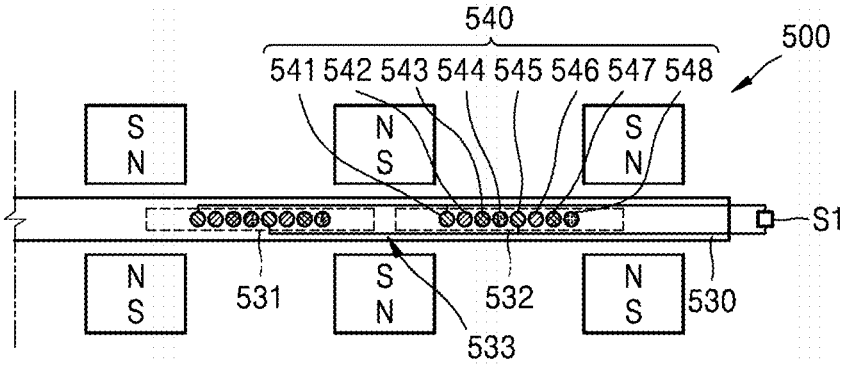
FIG. 13 is a cross-sectional view of the planar magnet speaker of FIG. 12 taken along a line B-B' according to an exemplary embodiment.

FIG. 12 is a plan view of a membrane 530 included in a planar magnet speaker 500 according to another exemplary embodiment. FIG. 13 is a cross-sectional view of the planar magnet speaker 500 of FIG. 12 taken along a line B-B' according to another exemplary embodiment.

A plurality of electric wires 540 may include a first electric wire 541, a second electric wire 542, a third electric wire 543, a fourth electric wire 544, a fifth electric wire 545, a sixth electric wire 546, a seventh electric wire 547, and an eighth electric wire 548. The first electric wire 541, the second electric wire 542, the third electric wire 543, the fourth electric wire 544, the fifth electric wire 545, the sixth electric wire 546, the seventh electric wire 547, and the eighth electric wire 548 may form at least one loop in a first pattern area 531 and at least one loop in a second pattern area 532. The first pattern area 531 and the second pattern area 532 may be separated by a gap 533. The first electric wire 541 and the fifth electric wire 545 may have the same carrier phase. The second electric wire 542 and the sixth electric wire 546 may have the same carrier phase. The third electric wire 543 and the seventh electric wire 547 may have the same carrier phase. The fourth electric wire 544 and the eighth electric wire 548 may have the same carrier phase. For example, one end of the first electric wire 541 and one end of the fifth electric wire 545 may be connected to each other, and one end of the second electric wire 542 and one end of the sixth electric wire 546 may be connected to each other, one end of the third electric wire 543 and one end of the seventh electric wire 547 may be connected to each other, and one end of the fourth electric wire 544 and one end of the eighth electric wire 547 may be connected to each other.

According to an exemplary embodiment, when a first carrier phase is applied to the first electric wire 541 and a fifth electric wire 545, a second carrier phase is applied to the second electric wire 542 and the sixth electric wire 546, a third carrier phase is applied to the third electric wire 543 and the seventh electric wire 547, and a fourth carrier phase is applied to the fourth electric wire 544 and the eighth electric wire 548, the first carrier phase, the second carrier phase, the third carrier phase, and the fourth carrier phase may be different from each other. For example, the first carrier phase and the second carrier phase may differ by 90 degrees from each other, the second carrier phase and the third carrier phase may differ by 90 degrees from each other, and the third carrier phase and the fourth carrier phase may differ by 90 degrees from each other. The first electric wire 541, the second electric wire 542, the third electric wire 543, the fourth electric wire 544, the fifth electric wire 545, the sixth electric wire 546, the seventh electric wire 547, and the eighth electric wire 548 may be positioned so that the carrier signals may interfere with each other.

Referring to FIG. 12, the planar magnet speaker 500 may include at least one switch S1, S2, S3, S4 for switching connections between the plurality of electric wires 540 to adjust the impedance. For example, a connection between the first electric wire 541 and the fifth electric wire 545 may be switched by the switch S1, a connection between the second electric wire 542 and the sixth electric wire 546 may be switched by the switch S2, a connection between the third electric wire 543 and the seventh electric wire 547 may be switched by the switch S3, and a connection between the fourth electric wire 544 and the eighth electric wire 548 may be switched by the switch S4. The switches S1, S2, S3, and S4 may be used to adjust the impedance by switching the connections between the plurality of electric wires 540.

Figure 14:
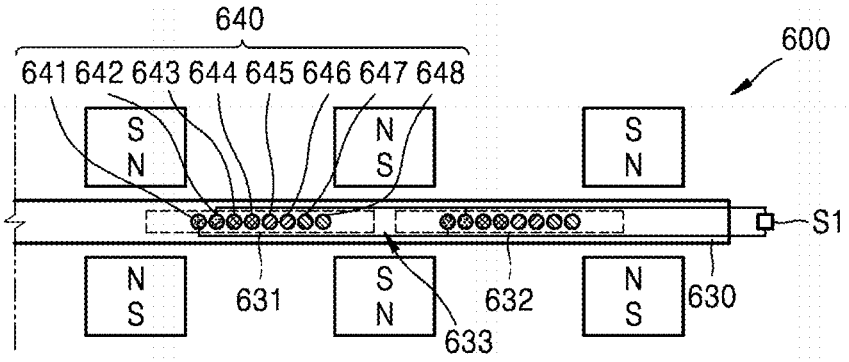
FIG. 14 is a schematic cross-sectional view of a planar magnet speaker according to another exemplary embodiment.

FIG. 14 is a schematic cross-sectional view of a planar magnet speaker 600 including a membrane 630, according to another exemplary embodiment. Referring to FIG. 14, components except for an arrangement of a plurality of electric wires 620 are substantially the same as those of the above-described planar magnet speaker 500, so redundant descriptions are omitted.

A plurality of electric wires 640 may include a first electric wire 641, a second electric wire 642, a third electric wire 643, a fourth electric wire 644, a fifth electric wire 645, a sixth electric wire 646, a seventh electric wire 647, and an eighth electric wire 648. The first electric wire 641, the second electric wire 642, the third electric wire 643, the fourth electric wire 644, the fifth electric wire 645, the sixth electric wire 646, the seventh electric wire 647, and the eighth electric wire 648 may form at least one loop in a first pattern area 631 and at least one loop in a second pattern area 632. The first pattern area 631 and the second pattern area 632 may be separated by a gap 633.

The first electric wire 641 and the second electric wire 642 may be connected to each other to have the same first carrier phase. The third electric wire 643 and the fourth electric wire 644 may be connected to each other to have the same second carrier phase. The fifth electric wire 645 and the sixth electric wire 646 may be connected to each other to have the same third carrier phase. The seventh electric wire 647 and the eighth electric wire 648 may be connected to each other to have the same fourth carrier phase. For example, the first carrier phase and the second carrier phase may differ by 90 degrees from each other, the second carrier phase and the third carrier phase may differ by 90 degrees from each other, and the third carrier phase and the fourth carrier phase may differ by 90 degrees from each other.

A connection between the first electric wire 641 and the second electric wire 642 may be switched by the switch S1. A connection between the third electric wire 643 and the fourth electric wire 644 may be switched by the switch (not shown S2). A connection between the fifth electric wire 645 and the sixth electric wire 646 may be switched by the switch (not shown S3). A connection between the seventh electric wire 647 and the eighth electric wire 648 may be switched by the switch (not shown S4).

Figure 15:
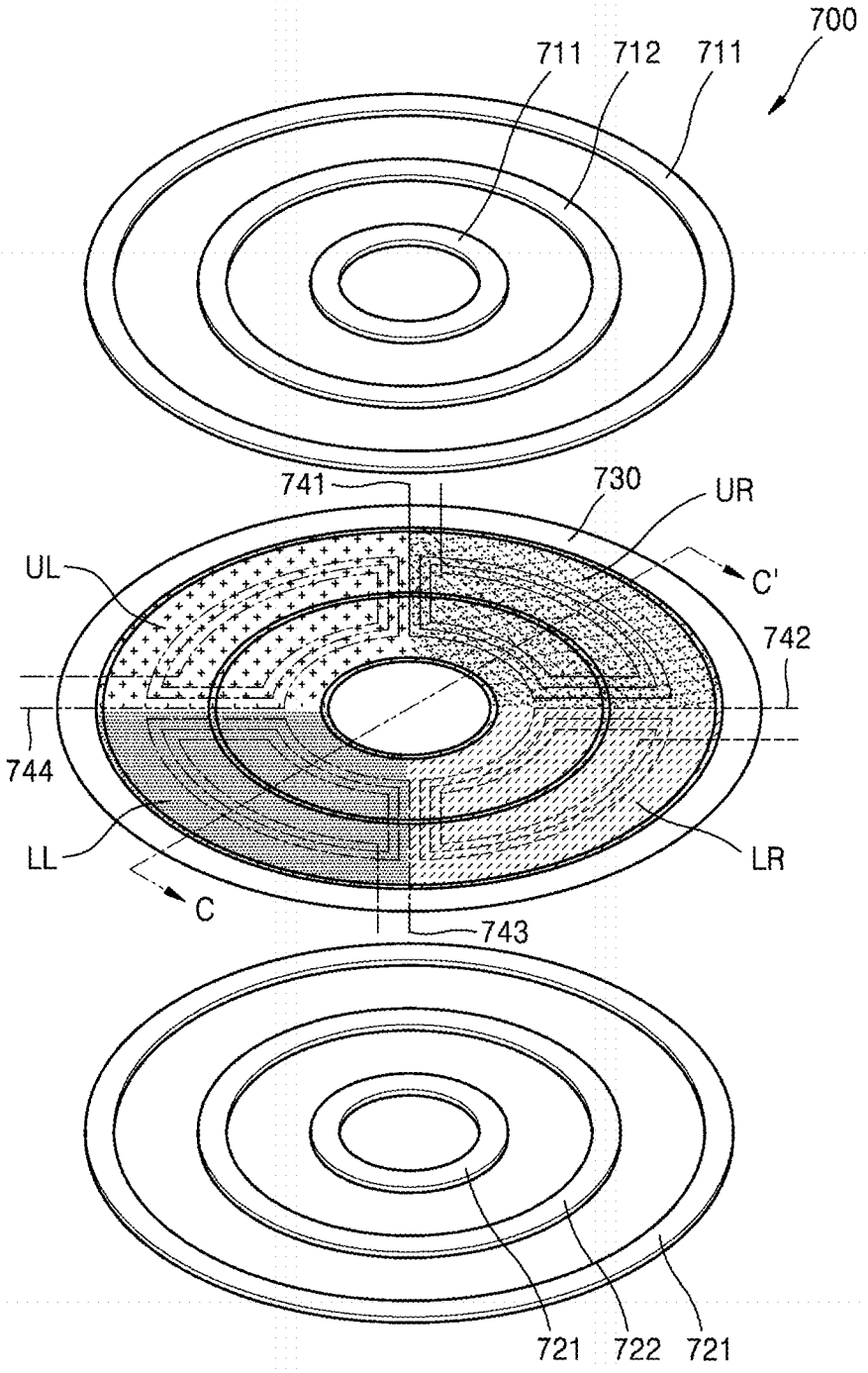
FIG. 15 is a schematic perspective view of a configuration of a planar magnet speaker according to another exemplary embodiment.
Figure 16:
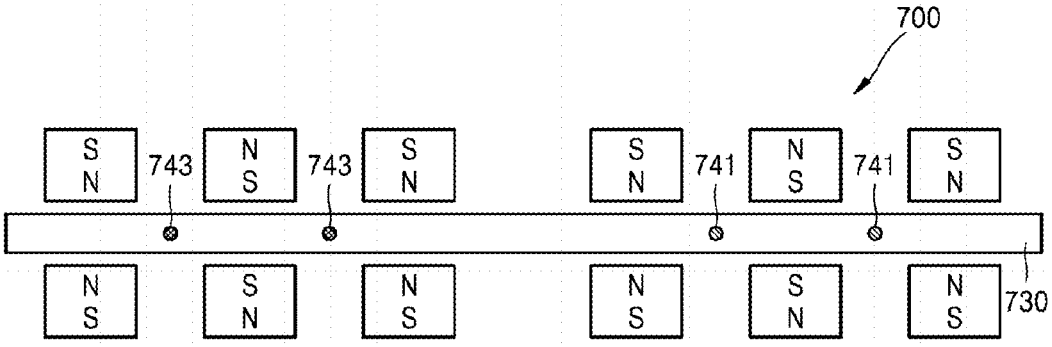
FIG. 16 is a cross-sectional view of the planar magnet speaker of FIG. 15 taken along a line C-C according to an exemplary embodiment'.

FIG. 15 is a schematic perspective view of a configuration of a planar magnet speaker 700 according to another exemplary embodiment. FIG. 16 is a cross-sectional view of the planar magnet speaker 700 of FIG. 15 taken along a line C-C' according to another exemplary embodiment.

Referring to FIGS. 15 and 16, a membrane 730 may include a plurality of partition areas may be provided between first magnets (711 and 712) and second magnets (721 and 722). For example, the membrane 730 may be divided into four partition areas. A plurality of electric wires 741, 742, 743, and 744 may form a separate loop in each of the partition areas. For example, referring to FIG. 15, the first electric wire 741 may form at least one loop in a first partition area (UR) located at the upper right upper end of the membrane 730, the second electric wire 742 may form at least one loop in a second partition area (LR) located at the lower right end, the third electric wire 743 may form at least one loop in a third partition area (LL) located at the lower left, and the fourth electric wire 744 may form at least one loop in a fourth partition area (UL) at the left upper end.

The plurality of electric wires 741, 742, 743, and 744 may receive separate carrier signals and sound signals, respectively. Carrier phases of the carrier signals inputted to the plurality of electric wires 741, 742, 743, and 744 may be different from each other or may be the same, and are not particularly limited. The reason is that the carrier phases of the plurality of electric wires 741, 742, 743, and 744 located in different partition areas may not interfere with each other. For example, the plurality of electric wires 741, 742, 743, and 744 may receive different sound signals for each of a plurality of partition areas.

Two or more electric wires may form a loop in one partition area. For example, the first electric wire 741 may form at least one loop in the first partition area and a fifth electric wire (not shown) may form at least one loop in the first partition area. For example, a carrier signal having a first carrier phase may be input to the first electric wire 741, and a carrier signal having a second carrier phase may be input to the fifth electric wire (not shown). The first carrier phase and the second carrier phase may be different from each other. The first electric wire 741 and the fifth electric wire (not shown) may be adjacent to each other such that the carrier signals may interfere with each other. As described above, the first electric wire 741 and the fifth electric wire (not shown) may reduce the power loss through interference of the carrier signals. According to an exemplary embodiment, an electric wire arrangement method according to the exemplary embodiments of FIGS. 7 to 14 may be applied to the planar magnet speaker 700 of FIG. 15. The opposite may also be applied.

Figure 17:
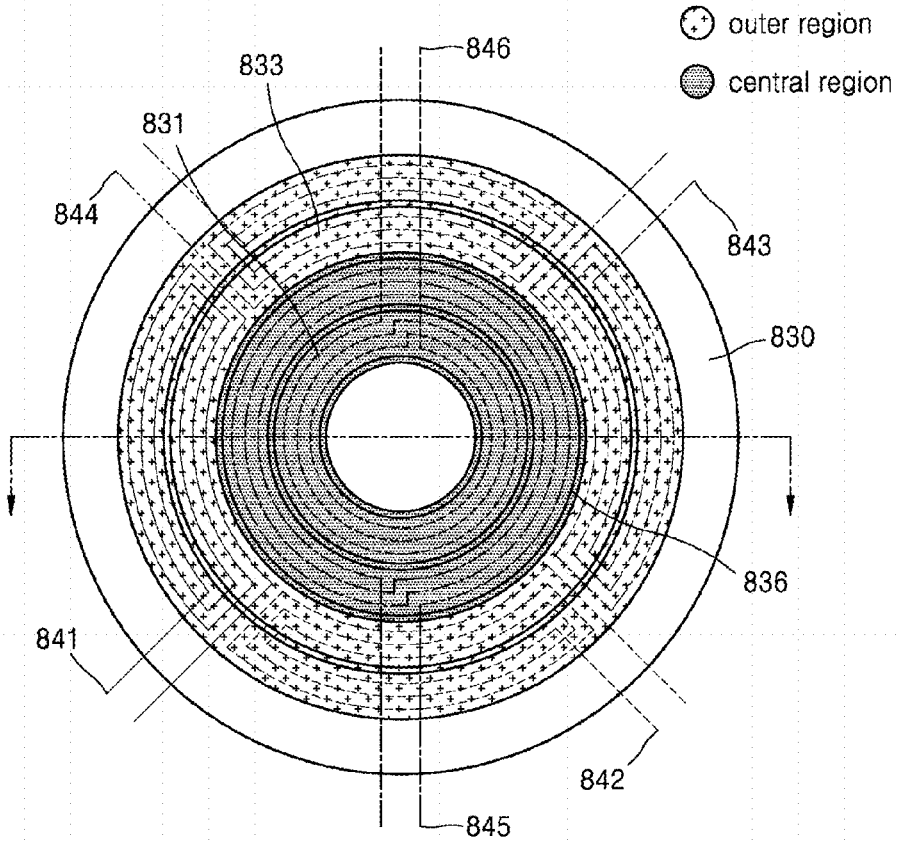
FIG. 17 is a plan view of a membrane included in a planar magnet speaker according to another exemplary embodiment.
Figure 18:
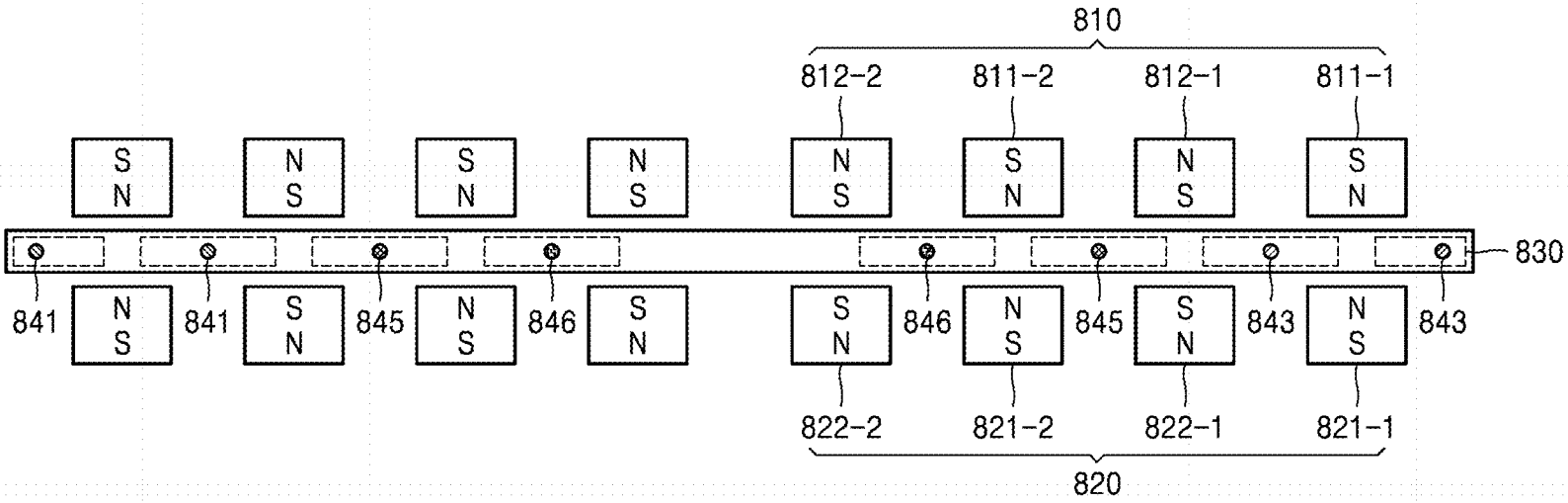
FIG. 18 is a schematic cross-sectional view of the planar magnet speaker of FIG. 17 according to an exemplary embodiment.

FIG. 17 is a plan view of a membrane 830 included in a planar magnet speaker 800 according to another exemplary embodiment. FIG. 18 is a schematic cross-sectional view of the planar magnet speaker 800 of FIG. 17 taken along a line D-D' according to another exemplary embodiment.

Referring to FIGS. 17 and 18, the membrane 830 may include a plurality of partition areas. The membrane 830 may include a first partition area 833 located in an outer region and a second partition area 831 located in a central region. According to an exemplary embodiment, the second partition area is an inner region located inside of the outer region. The pattern areas 831 and 833 may be separated by a gap 836.

A first magnet member 810 may include a magnet 811-1, magnet 812-1, magnet 811-2, and a magnet 812-2 which are alternately arranged from the outermost portion. A polarity of the magnet 811-1 toward the membrane 830 and a polarity of the magnet 812-1 toward the membrane 830 may be opposite to each other. The second magnet member 820 may include a magnet 821-1, magnet 822-1, magnet 821-2 and a magnet 822-2 which are alternately arranged from the outermost portion.

A plurality of electric wires, including electric wires 841, 842, 843, and 844 may be provided in the partition area located in the outer region, and including electric wires 845 and 846 may be provided in the partition area located in the central region. Descriptions of the electric wires 841, 842, 843, and 844 are substantially similar to an arrangement of the electric wires 741, 742, 743, and 744 in FIGS. 15 and 16, and thus redundant descriptions thereof are omitted.

The electric wires 845 and 846 may surround at least one partition area that is located in the central region of the membrane 830. Referring to FIG. 17, the fifth electric wire 845 and the sixth electric wire 846 may form loops in different partition areas. The fifth electric wire 845 and the sixth electric wire 846 may receive separate carrier signals and sound signals. A carrier phase of the carrier signal input to the fifth electric wire 845 and a carrier phase of the carrier signal input to the sixth electric wire 846 may be the same or different. The sound signals input to the fifth electric wire 845 and the sixth electric wire 846 may be different from each other. For example, amplitude of the sound signal input to the fifth electric wire 845 may be greater than amplitude of the sound signal input to the sixth electric wire 846.

The planar magnet speaker 800 according to the present exemplary embodiment may separately control vibration by dividing the membrane 830 into the central region and the outer region. For example, the planar magnet speaker 800 may produce a uniform vibration in the central region of the membrane 830, prevent distortion of the outer region of the membrane 830, and produce a stable sound even in a low sound region.

Figure 19:
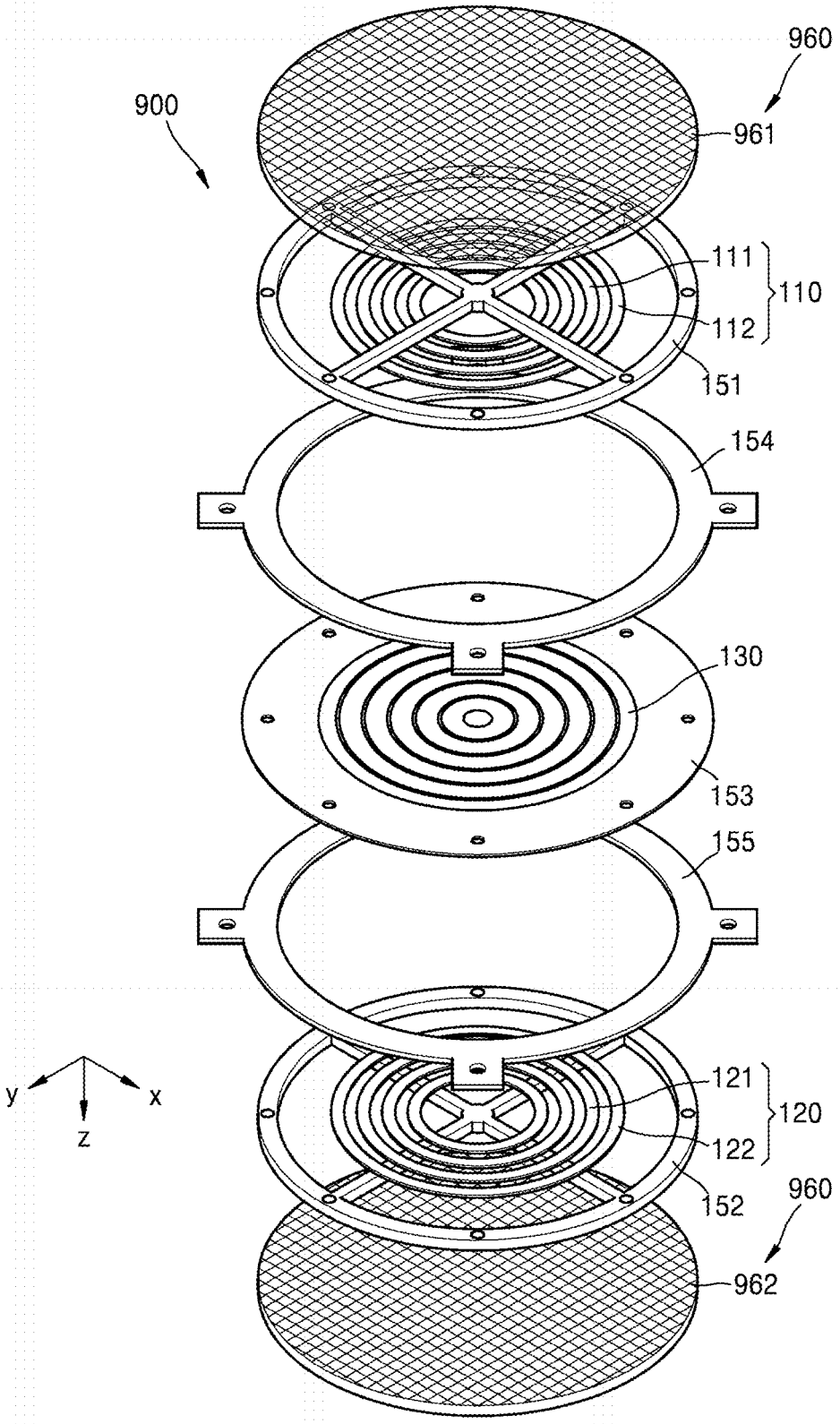
FIG. 19 is an exploded perspective view showing a planar magnet speaker according to another exemplary embodiment.
Figure 20:
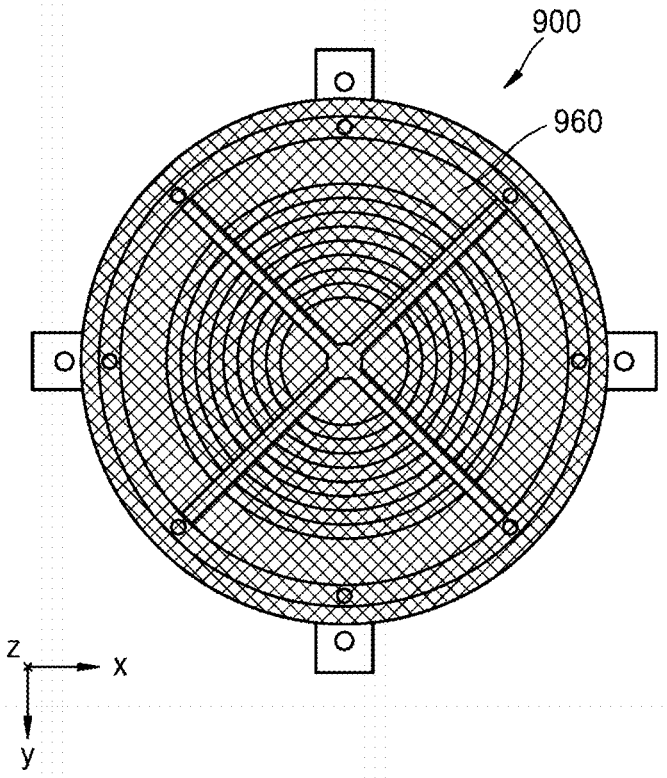
FIG. 20 is a plan view of the planar magnet speaker of FIG. 19 viewed from a vertical direction according to an exemplary embodiment.
Figure 21:
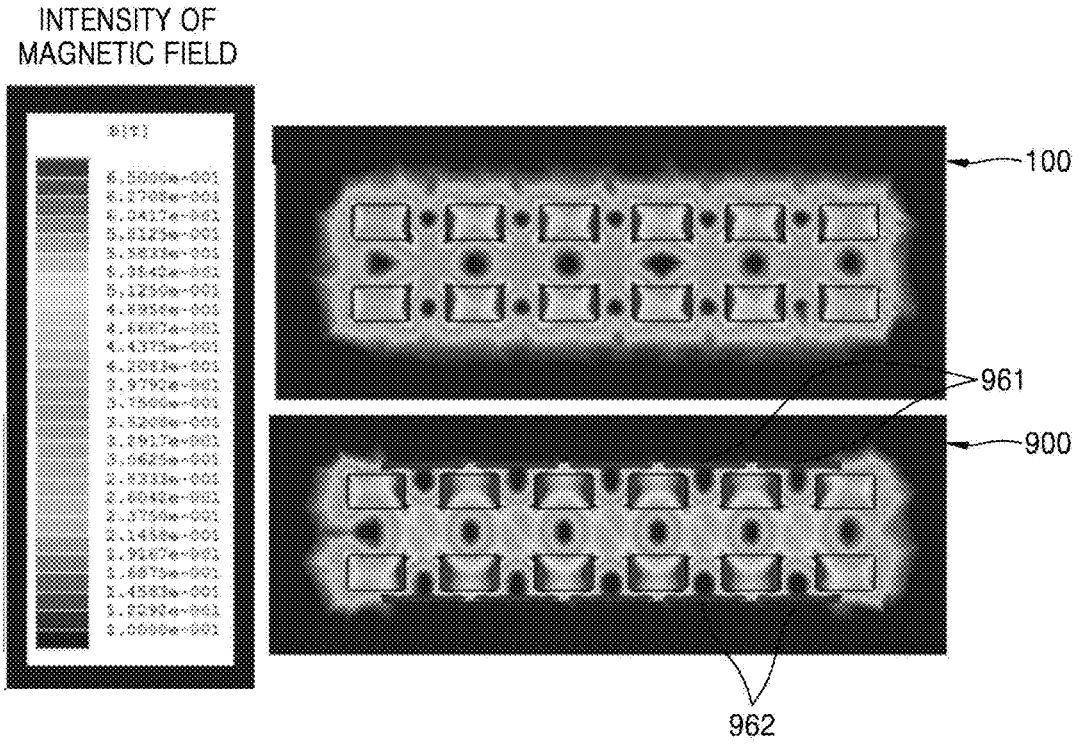
FIG. 21 is a diagram for comparing magnitudes of magnetic fields of the planar magnet speaker of FIG. 1 and the planar magnet speaker of FIG. 21 according to an exemplary embodiment.

FIG. 19 is an exploded perspective view showing a planar magnet speaker 900 according to another exemplary embodiment. FIG. 20 is a plan view of the planar magnet speaker 900 of FIG. 19 viewed from a vertical direction according to an exemplary embodiment. FIG. 21 is a diagram comparing magnitudes of magnetic fields of the planar magnet speaker 100 of FIG. 1 and the planar magnet speaker 900 of FIG. 21 according to an exemplary embodiment.

Referring to FIGS. 19 and 20, the planar magnet speaker 900 may include a first cover 961 covering the first magnet member 110 and a second cover 962 covering the second magnet member 120. Other components are the same as those described above with reference to the planar magnet speaker 100 of FIG. 1, and thus redundant descriptions are omitted.

The cover 960 may cover the outside to protect the planar magnet speaker 900 from external impact. The cover 960 may have a mesh structure so as not to block sound produced by vibration of the membrane 130. The cover 960 may be formed of various materials. For example, the cover 960 may be formed of a non-metallic material or a metallic material.

Referring to FIG. 21, when the cover 960 is formed of the metallic material, a magnetic field formed near the membrane 130 of the planar magnet speaker 900 may be strengthened. A first cover 961 having a metal mesh structure may cover the first magnet member 110 and a second cover 962 having a metal mesh structure may cover the second magnet member 120, and thus it may be seen that the magnetic field near the membrane 130 is stronger than the membrane 130 of FIG. 1. Since a vibration force of the membrane 130 is proportional to intensity of the magnetic field, the planar magnet speaker 900 may generate a stronger sound than the same input signal.

Figure 22:
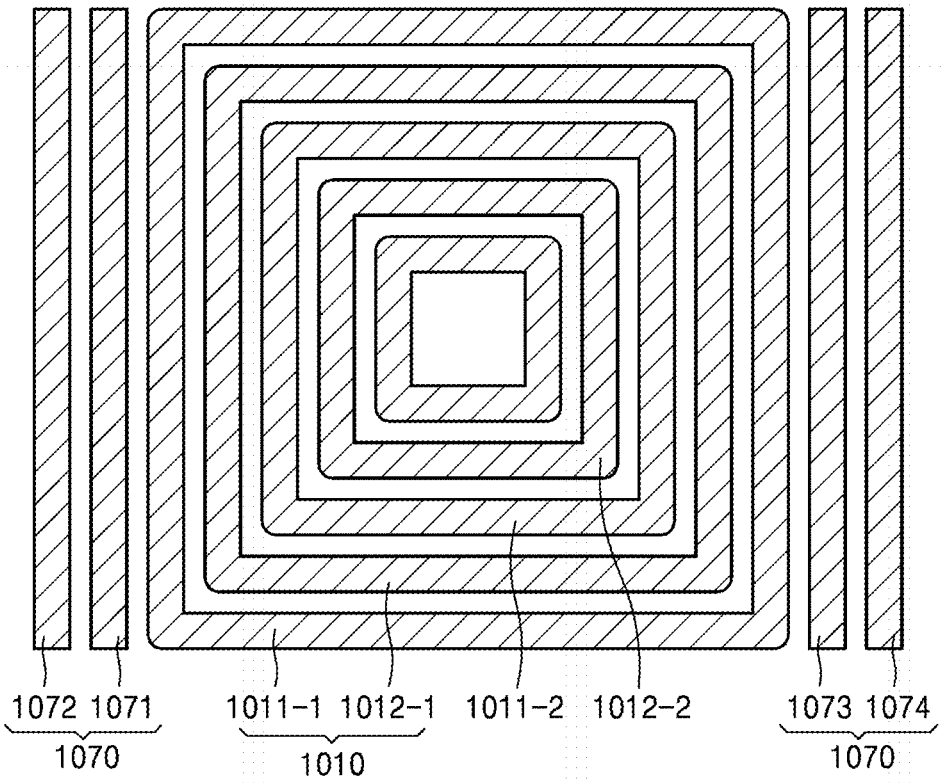
FIG. 22 is a plan view of an arrangement of a first magnet member and a first linear magnet included in a planar magnet speaker according to another exemplary embodiment.
Figure 23:
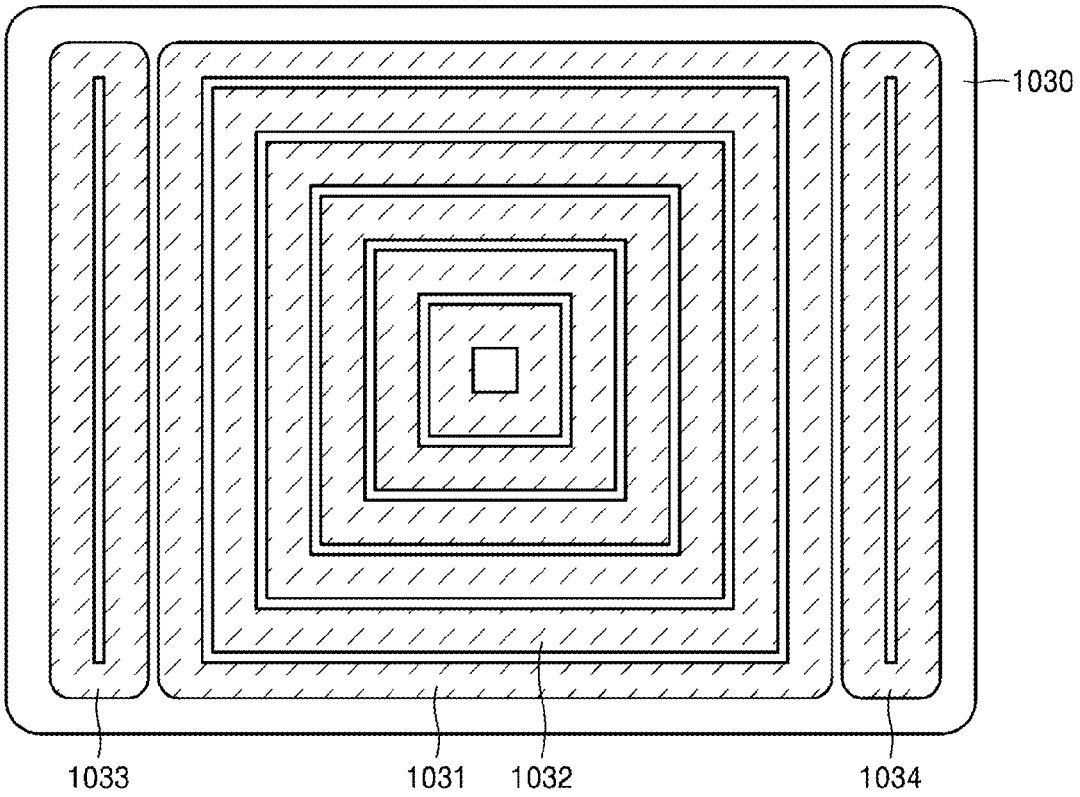
FIG. 23 is a schematic plan view of a membrane corresponding to the arrangement of the first magnet member and the first linear magnet of FIG. 22 according to an exemplary embodiment.

FIG. 22 is a plan view of an arrangement of a first magnet member 1010 and a first linear magnet member 1070 included in a planar magnet speaker according to another exemplary embodiment. FIG. 23 is a schematic plan view of a membrane corresponding to the arrangement of the first magnet member 1010 and the first linear magnet member 1070 of FIG. 22 according to an exemplary embodiment. Referring to FIGS. 22 and 23, the first magnet member 1010 may include a magnet 1011-1, a magnet 1012-1, a magnet 1011-2 and a magnet 1012-2 having a rectangular shape with a space inside. The first linear magnet member 1070 may be linear.

The first magnet member 1010 may have a concentric structure with respect to a central axis. For example, the magnet 1011-1 located at the outermost position may be separated from the magnet 1012-1 by a first distance, and the magnet 1011-1 and the magnet 1012-1 may have a concentric structure with respect to a first central axis. The magnet 1011-1 and the magnet 1012-1 may be alternately arranged so as to have polarities opposite to each other.

The first linear magnet member 1070 may be spaced a predetermined distance from the first magnet 1011-1, which is at the outermost position among the first magnet members 1010.

According to an exemplary embodiment, the first linear magnet member 1070 may include a linear magnet 1071 spaced apart from a left side of the first magnet 1011 by a certain distance, and a linear magnet 1073 spaced apart from the right side of the first magnet 1011-1 by a certain distance. A linear magnet 1072 may be separated from the first linear magnet 1071 by a certain distance and a linear magnet 1074 may be spaced apart from the first linear magnet 1073 by a certain distance. The linear magnet 1071 and the linear magnet 1072 may be alternately arranged so as to have polarities opposite to each other.

A second magnet member (not shown) may be provided to form a repulsion magnetic field with the first magnet member 1010. For example, when the first magnet member 1010 is positioned on a first plane, the second magnet member (not shown) may be provided on a second plane that is vertically spaced from the first plane. At least one second linear magnet (not shown) may be provided to form a repulsive magnetic field with the at least one first linear magnet member 1070. For example, the first linear magnet member 1070 may be provided on the same first plane as the first magnet member 1010. For example, the second linear magnet (not shown) may be provided on the same second plane as the second magnet member (not shown). A specific arrangement of the second magnet member (not shown) and the at least one second linear magnet (not shown) are the same as the first magnet member 1010 and the first linear magnet member 1070 described above, except that the second magnet member (not shown) and the at least one second linear magnet (not shown) are provided on the second plane, and thus redundant descriptions are omitted.

Referring to FIG. 23, the membrane 1030 may include pattern areas 1031 and 1032 corresponding to the first magnet member 1010 and pattern areas 1033 and 1034 corresponding to the arrangement of the first linear magnet member 1070. A specific arrangement of a plurality of electric wires (not shown) may include an arrangement of electric wires according to the above-described embodiment, and thus a detailed description thereof will be omitted.

Figure 24:
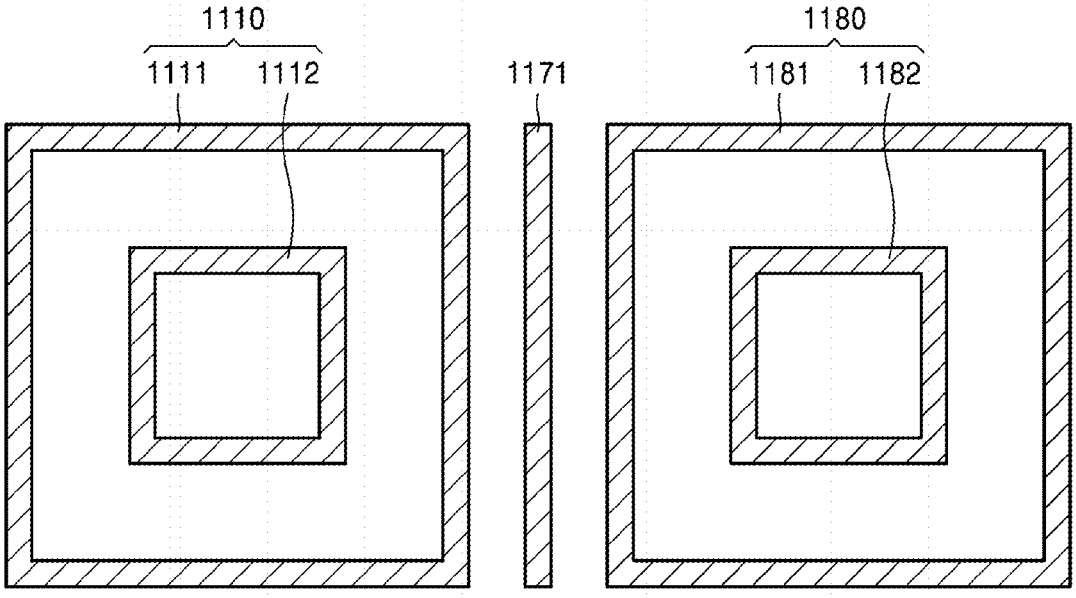
FIG. 24 is a plan view showing an arrangement of a first magnet member and a third magnet member included in a planar magnet speaker according to exemplary another embodiment.

FIG. 24 is a plan view showing an arrangement of a first magnet member 1110 and a third magnet member 1180 included in a planar magnet speaker according to another exemplary embodiment.

Referring to FIG. 24, the first magnet member 1110 may include a plurality of first magnets 1111 and 1112 with a rectangular shape having a space therein, and the third magnet member 1180 may include a plurality of third magnets 1181 and 1182 with a rectangular shape having a space therein. The first linear magnet 1171 may be located between a magnet 1111 located at the outermost position of the first magnet member 1110 and a magnet 1181 located at the outermost position of the third magnet member 1180. The first magnet member 1110, the first linear magnet 1171, and the third magnet member 1180 may be provided on a first plane.

The first magnet member 1110 may include the magnet 1111 and the magnet 1112 having a concentric structure with respect to a first central axis. As shown in FIG. 24, the first magnet member 1110 includes the two first magnets 1111 and 1112 but is not limited thereto and may include various numbers of first magnets. For example, the magnet 1111 and the magnet 1112 may be separated from each other by a first distance.

The third magnet member 1180 may include a magnet 1181 and a magnet 1182 having a concentric structure with respect to a second central axis. The second central axis may be spaced apart from the first central axis. For example, the magnet 1181 and the magnet 1182 may be separated from each other by a first distance.

A second magnet member (not shown) may be provided to form a repulsion magnetic field with the first magnet member 1110. A second linear magnet (not shown) may be provided to form a repulsion magnetic field with the first linear magnet 1171. The second magnet member (not shown) and the second linear magnet (not shown) may be provided on a second plane that is spaced apart in a direction perpendicular to the first plane. A specific arrangement of the second magnet member (not shown) and the second linear magnet (not shown) is the same as that of the first magnet member 1110 and the first linear magnet 1171, except that the second magnet member (not shown) and the second linear magnet (not shown) are provided on the second plane, and thus a redundant description will be omitted.

A fourth magnet member (not shown) may include a first magnet of the fourth magnet member (not shown) and a second magnet of fourth magnet member (not shown) having a concentric structure with respect to the second central axis. The fourth magnet member may be provided to form a repulsion magnetic field with the third magnet member 1180. The fourth magnet member may be provided on the second plane together with the second magnet member (not shown) and the second linear magnet (not shown).

The first linear magnet 1171 may be spaced a certain distance from the magnet 1111 and the magnet 1181. The distance between the linear magnet 1171 and the magnet 1111 and the magnet 1181 may be determined differently depending on an arrangement of a specific electric wire (not shown).

An arrangement of a first magnet according to the exemplary embodiment according to FIGS. 22 to 24 may be used when a planar magnet speaker of a rectangular shape is to be implemented. When a planar magnet speaker for mounting on a thin film type display or a planar magnet speaker of a sound bar type is to be implemented, a major axis may be generally a rectangle or an ellipse which is two times longer than a minor axis. At this time, the rectangular or elliptical magnet may be more expensive and difficult to manufacture than a square or circular magnet. By using the square magnet, the planar magnet speaker for mounting on the thin film type display or the planar magnet speaker of the sound bar type may be easily implemented by using the embodiment shown in FIGS. 22 to 24.

Figure 25:
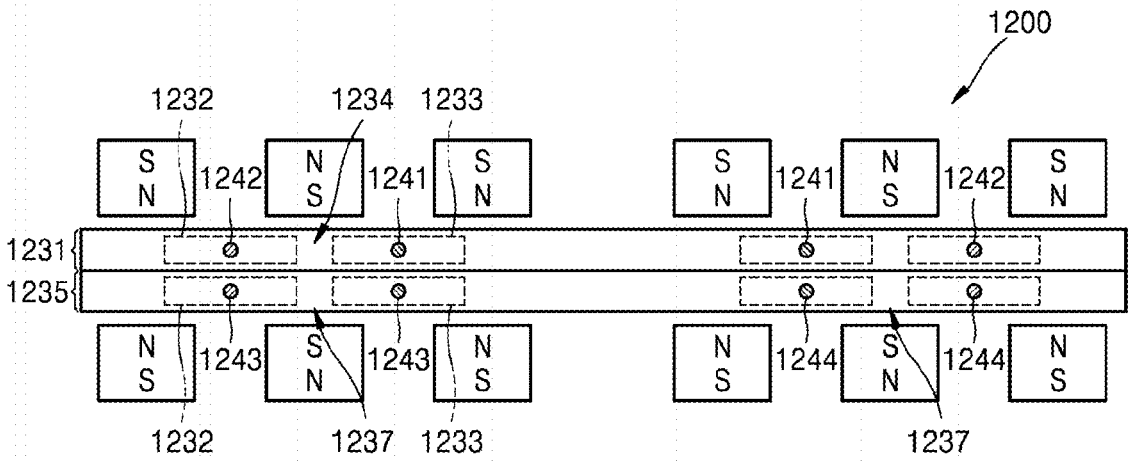
FIG. 25 is a schematic cross-sectional view of a planar magnet speaker according to another exemplary embodiment.

FIG. 25 is a schematic cross-sectional view of a planar magnet speaker 1200 according to another exemplary embodiment.

Referring to FIG. 25, membranes 1231 and 1235 may include a first layer membrane 1231 and a second layer membrane 1235. The second layer membrane 1235 may be stacked on the first layer membrane 1231. Some electric wires 1241 and 1242 of a plurality of electric wires 1240 may be provided on the first layer membrane 1231 and other electric wires 1243 and 1244 may be provided on the second layer membrane 1235. Although the membranes 1231 and 1235 have a two-layer structure, but are not limited thereto and may have a stack structure of three or more layers.

The first layer membrane 1231 may include a pattern area 1232 and a pattern area 1233 with a gap 1234 therebetween. For example, the first electric wire 1241 may be provided in the pattern area 1233, and the second electric wire 1242 may be provided in the pattern area 1234. Such an arrangement is only an example and the current exemplary embodiment is not limited thereto. For example, a plurality of electric wires may be provided to apply different carrier phases to the pattern area 1233, or a plurality of electric wires may be provided such that an individual signal is applied to each of partition areas of the first layer membrane 1231.

The second layer membrane 1235 may include a pattern area 1233 and a pattern area 1236 with a gap 1237 therebetween. The plurality of electric wires 1243 and 1244 may be provided for each partition area so as to apply a separate input to each partition area of the second layer membrane 1235. For example, the third electric wire 1243 may be provided to enclose a partition area located in the left on the cross-sectional view at least once, and the fourth electric wire 1244 may be provided to enclose a partition area located in the right on the cross-sectional view at least once. The second layer membrane 1235 may also include various arrangements of electric wires, and is not limited to the example described above.

The planar magnet speaker 1200 according to the present exemplary embodiment may include the membranes 1231 and 1235 of the stack structure, and thus lengths of electric wires relative to areas of the membranes 1231 and 1235 may be extended. In addition, arrangements of the electric wires of the membranes 1231 and 1235 for each layer may be varied, and characteristics may be adjusted in various ways during generation of sound. For example, the planar magnet speaker 1200 may include an arrangement of electric wires capable of producing strong sound in a low band.

A structure of the plurality of electric wires 1240 arranged in the first layer membrane 1231 and the second layer membrane 1235 may be applied to various exemplary embodiments described above and are not limited to the embodiment of FIG. 25.

A planar magnet speaker according to an exemplary embodiment may include a plurality of electric wires to enable multiple inputs. The planar magnet speaker may be thin and have excellent sound reproduction in a low frequency range.

A planar magnet speaker according to an exemplary embodiment may include a separate electric wire for each of partition areas of a membrane, thereby individually controlling vibration for each of the partition areas.

A planar magnet speaker according to an exemplary embodiment may input a multi-carrier phase with a plurality of electric wires, thereby preventing power loss and electronic disturbance due to a carrier phase.

A planar magnet speaker according to an exemplary embodiment may include a membrane formed to have a multilayer structure, thereby individually controlling vibration of a membrane for each layer.

An impedance of a planar magnet speaker according to an exemplary embodiment may be changed by switching connections between multiple inputs.

One or more exemplary embodiments of planar magnet speakers are provided in this present disclosure with accompanying drawings facilitate understanding of the exemplary features of the present disclosure. However, it should be understood that the embodiments described herein should be considered in a descriptive sense only and not for purposes of limitation. Descriptions of features or aspects within each exemplary embodiment should typically be considered as available for other similar features or aspects in other exemplary embodiments.

While one or more embodiments have been described with reference to the figures, it will be understood by those of ordinary skill in the art that various changes in form and details may be made therein without departing from the spirit and scope as defined by the following claims.

What is claimed is:

1. A planar magnet speaker comprising:

a first magnet member comprising a plurality of first magnets, the plurality of first magnets being concentrically disposed;

a second magnet member spaced apart from the first magnet member and comprising a plurality of second magnets, the plurality of second magnets being concentrically disposed; and a membrane provided between the first magnet member and the second magnet member and comprising one or more wires, wherein the membrane is configured to generate sound according to a signal applied to the one or more wires, and wherein an inner portion of at least two of the plurality of first magnets has an opening, wherein the one or more wires comprise a first wire and a second wire, wherein the first wire is configured to receive a first carrier signal having a first phase, and wherein the second wire is configured to receive a second carrier signal having a second phase different from the first phase.

2. The planar magnet speaker of claim 1, wherein the first magnet member is formed on a first plane, and wherein the second magnet member is formed on a second plane, which is parallel to the first plane, and is spaced apart from the first magnet member.

3. The planar magnet speaker of claim 2, further comprising:

a third magnet member on the first plane and comprising a plurality of third magnets having same shape and different sizes; and a fourth magnet member on the second plane spaced apart from the first plane in a perpendicular direction and comprising a plurality of fourth magnets having same shape and different sizes, wherein the plurality of third magnets are arranged to form a repulsion magnetic field with the plurality of fourth magnets, wherein the first magnet member and the second magnet member form a concentric structure with respect to a first central axis, and the plurality of third magnets and the plurality of fourth magnets form a concentric structure with respect to a second center axis spaced apart from the first central axis, and wherein a support frame supports the third magnet member and the fourth magnet member.

4. The planar magnet speaker of claim 1, further comprising a support frame configured to support the first magnet member, the second magnet member, and the membrane.

5. The planar magnet speaker of claim 4, wherein the support frame comprises a first magnet frame for supporting the first magnet member and a second magnet frame for supporting the second magnet member.

6. The planar magnet speaker of claim 5, wherein the support frame further comprises a spacing frame provided between the first magnet frame and the second magnet frame to separate the first magnet frame and the second magnet frame by a predetermined distance.

7. The planar magnet speaker of claim 6, wherein the support frame further comprises an edge member provided between the spacing frame and the membrane to support the membrane, wherein the edge member is coupled along a periphery of the membrane.

8. The planar magnet speaker of claim 1, wherein each of the plurality of first magnets are arranged at regular intervals from one another.

9. The planar magnet speaker of claim 1, wherein the second magnet member is symmetrically arranged with respect to the first magnet member.

10. The planar magnet speaker of claim 1, wherein the plurality of first magnets are arranged to have alternate polarities, and wherein the plurality of second magnets are arranged to form a repulsion magnetic field with the plurality of first magnets.

11. The planar magnet speaker of claim 1, wherein the signal comprises a sound signal, and the first and second carrier signals modulating the sound signal.

12. The planar magnet speaker of claim 11, wherein the membrane may further comprise a pattern area in which the one or more wires are provided.

13. The planar magnet speaker of claim 12, wherein the first wire and the second wire overlap in a direction parallel to a surface of the membrane.

14. The planar magnet speaker of claim 13, wherein the first wire is configured to form a loop in the pattern area, and wherein the second wire is configured to form a separate loop from the first wire in the pattern area.

15. The planar magnet speaker of claim 12, further comprising:

at least one switch configured to switch connections between the one or more wires for adjusting an impedance of the planar magnet speaker.

16. The planar magnet speaker of claim 12, wherein the membrane further comprises a first layer membrane and a second layer membrane in a stack structure, and wherein a first wire, among the one or more wires, is provided in the first layer membrane and a second wire, among the one or more wires, is provided in the second layer membrane.

17. The planar magnet speaker of claim 1, wherein the membrane is divided into a plurality of partition areas, and wherein each of the partition areas comprises at least one wire, among the one or more wires, that forms a separate loop in the respective partition area.

18. The planar magnet speaker of claim 1, further comprising a cover provided on one surface of the first magnet member or the second magnet member, wherein the cover has a mesh structure.

19. The planar magnet speaker of claim 1, wherein each of the first magnet member and the second magnet member has a circular shape having a space therein, an elliptical shape having a space therein, a rectangular shape having a space therein, or a polygon shape having a space therein.

20. The planar magnet speaker of claim 1, wherein the plurality of first magnets and the plurality of second magnets form a rectangular shape having an outer boundary and an inner boundary, the planar magnet speaker further comprises:

at least one first linear magnet spaced apart by a first distance from a first magnet located at an outermost position among the plurality of first magnets; and a second linear magnet spaced apart by a second distance from a second magnet located at an outermost position among the plurality of second magnets, wherein the first linear magnet is arranged to form a repulsive magnetic field with the second linear magnet.

* * * * *